US010010770B2

(12) United States Patent
Parsons et al.

(10) Patent No.: US 10,010,770 B2
(45) **Date of Patent: *Jul. 3, 2018**

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Bradley D. Schweigert, Anthem, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/807,201

(22) Filed: Nov. 8, 2017

(65) Prior Publication Data

US 2018/0065006 A1 Mar. 8, 2018

Related U.S. Application Data

(63) Continuation of application No. 15/463,306, filed on Mar. 20, 2017, now Pat. No. 9,821,200, which is a continuation of application No. 15/249,857, filed on Aug. 29, 2016, now Pat. No. 9,630,070, which is a continuation-in-part of application No. 29/559,452, filed on Mar. 28, 2016, now Pat. No. Des. 767,696, and a continuation-in-part of application No.

(Continued)

(51) Int. Cl.
*A63B 53/04* (2015.01)
*A63B 53/06* (2015.01)

(52) U.S. Cl.
CPC ..... *A63B 53/0466* (2013.01); *A63B 53/06* (2013.01); *A63B 53/04* (2013.01); *A63B 53/0475* (2013.01); *A63B 2053/045* (2013.01); *A63B 2053/0433* (2013.01); *A63B 2053/0491* (2013.01); *A63B 2209/00* (2013.01)

(58) Field of Classification Search
CPC ..... A63B 53/06; A63B 53/04; A63B 53/0466; A63B 53/0475; A63B 2053/045; A63B 2053/0433; A63B 2053/0491; A63B 2209/00
USPC ..... 473/332, 334, 335, 338, 339, 345, 346, 473/349
See application file for complete search history.

(56) References Cited

U.S. PATENT DOCUMENTS 1,133,129 A 3/1915 Govan
1,269,745 A 6/1918 Robertson
(Continued)

OTHER PUBLICATIONS

International Search Report and Written Opinion received in connection with corresponding application No. PCT/US2015/016666, dated May 14, 2015 (8 pages).
(Continued)

*Primary Examiner* — Benjamin Layno

(57) ABSTRACT

Embodiments of golf club heads and methods to manufacture golf club heads are generally described herein. In one example, a golf club head may include a hollow body portion having a front portion, a rear portion, a toe portion, a heel portion, a bottom portion, a top portion, a plurality of ports on the bottom portion and a plurality of inner support portions in the hollow body portion. Other examples and embodiments may be described and claimed.

17 Claims, 25 Drawing Sheets

Related U.S. Application Data

15/040,892, filed on Feb. 10, 2016, now Pat. No. 9,550,096, said application No. 29/559,452 is a continuation-in-part of application No. 29/552,228, filed on Jan. 21, 2016, said application No. 15/040,892 is a continuation-in-part of application No. 14/939,849, filed on Nov. 12, 2015, now Pat. No. 9,555,295, which is a continuation of application No. 14/615,606, filed on Feb. 6, 2015, now Pat. No. 9,199,140.

(60) Provisional application No. 62/362,491, filed on Jul. 14, 2016, provisional application No. 62/361,988, filed on Jul. 13, 2016, provisional application No. 62/337,184, filed on May 16, 2016, provisional application No. 62/301,756, filed on Mar. 1, 2016, provisional application No. 62/296,506, filed on Feb. 17, 2016, provisional application No. 62/281,639, filed on Jan. 21, 2016, provisional application No. 62/109,510, filed on Jan. 19, 2015, provisional application No. 62/105,123, filed on Jan. 19, 2015, provisional application No. 62/101,543, filed on Jan. 9, 2015, provisional application No. 62/048,693, filed on Sep. 10, 2014, provisional application No. 62/042,155, filed on Aug. 26, 2014.

(56) References Cited

U.S. PATENT DOCUMENTS

| | | | | |
|---|---|---|---|---|
| 1,306,029 | A | 6/1919 | Robertson | |
| D55,867 | S | 7/1920 | Mattern | |
| 1,534,600 | A | 4/1925 | Mattern | |
| 1,538,312 | A | 5/1925 | Beat | |
| D138,437 | S | 8/1944 | Link | |
| D138,438 | S | 8/1944 | Link | |
| D138,442 | S | 8/1944 | Link | |
| 3,652,094 | A | 3/1972 | Glover | |
| D240,748 | S | 7/1976 | Bock | |
| 4,085,934 | A | 4/1978 | Churchward | |
| D253,778 | S | 12/1979 | Madison | |
| D307,783 | S | 5/1990 | Linuma | |
| D326,885 | S | 6/1992 | Paul | |
| 5,316,298 | A * | 5/1994 | Hutin | A63B 53/04 273/DIG. 23 |
| D351,883 | S | 10/1994 | Solheim et al. | |
| 5,518,243 | A | 5/1996 | Redman | |
| D378,111 | S | 2/1997 | Parente et al. | |
| D384,120 | S | 9/1997 | De La Cruz et al. | |
| 5,788,584 | A | 8/1998 | Parente et al. | |
| D400,625 | S | 11/1998 | Kubica et al. | |
| D400,627 | S | 11/1998 | Kubica et al. | |
| D405,489 | S | 2/1999 | Kubica et al. | |
| D405,492 | S | 2/1999 | Kubica et al. | |
| 5,997,415 | A | 12/1999 | Wood | |
| D444,830 | S | 7/2001 | Kubica et al. | |
| 6,409,612 | B1 | 6/2002 | Evans et al. | |
| D478,140 | S | 8/2003 | Burrows | |
| 6,638,182 | B2 | 10/2003 | Kosmatka | |
| 6,773,360 | B2 | 8/2004 | Willett et al. | |
| D508,969 | S | 8/2005 | Hasebe | |
| D513,051 | S | 12/2005 | Barez et al. | |
| D514,179 | S | 1/2006 | Chen et al. | |
| D514,185 | S | 1/2006 | Barez et al. | |
| D520,586 | S | 5/2006 | Bingman | |
| D522,077 | S | 5/2006 | Schweigert et al. | |
| D522,601 | S | 6/2006 | Schweigert et al. | |
| D523,498 | S | 6/2006 | Chen et al. | |
| D526,694 | S | 8/2006 | Schweigert et al. | |
| 7,121,956 | B2 | 10/2006 | Lo | |
| D534,599 | S | 1/2007 | Barez et al. | |
| 7,166,040 | B2 | 1/2007 | Hoffman et al. | |
| D536,401 | S | 2/2007 | Kawami | |
| D536,403 | S | 2/2007 | Kawami | |
| 7,186,190 | B1 | 3/2007 | Beach et al. | |
| 7,223,180 | B2 | 5/2007 | Willette et al. | |
| 7,261,646 | B2 | 8/2007 | De Shiell et al. | |
| D563,498 | S | 3/2008 | Jertson et al. | |
| D564,054 | S | 3/2008 | Jertson et al. | |
| D564,055 | S | 3/2008 | Jertson et al. | |
| 7,338,338 | B2 | 3/2008 | Schweigert et al. | |
| 7,347,794 | B2 | 3/2008 | Schweigert | |
| D567,317 | S | 4/2008 | Jertson et al. | |
| D569,933 | S | 5/2008 | Jertson et al. | |
| D569,934 | S | 5/2008 | Jertson et al. | |
| D569,935 | S | 5/2008 | Schweigert et al. | |
| D569,936 | S | 5/2008 | Schweigert et al. | |
| D569,942 | S | 5/2008 | Jertson et al. | |
| D570,937 | S | 6/2008 | Schweigert et al. | |
| D570,938 | S | 6/2008 | Jertson et al. | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,448,964 | B2 | 11/2008 | Schineigert et al. | |
| 7,494,425 | B2 | 2/2009 | De Shiell et al. | |
| 7,530,904 | B2 | 5/2009 | Beach et al. | |
| D594,520 | S | 6/2009 | Schweigert et al. | |
| D594,521 | S | 6/2009 | Jertson et al. | |
| D594,919 | S | 6/2009 | Schweigert et al. | |
| 7,540,811 | B2 | 6/2009 | Beach et al. | |
| D597,620 | S | 8/2009 | Taylor et al. | |
| 7,568,985 | B2 | 8/2009 | Beach et al. | |
| 7,572,193 | B2 | 8/2009 | Yokota | |
| 7,578,753 | B2 | 8/2009 | Beach et al. | |
| D600,297 | S | 9/2009 | Jertson et al. | |
| 7,584,531 | B2 | 9/2009 | Schweigert et al. | |
| 7,588,502 | B2 | 9/2009 | Nishino | |
| 7,591,738 | B2 | 9/2009 | Beach et al. | |
| D603,472 | S | 11/2009 | Schweigert et al. | |
| 7,611,424 | B2 | 11/2009 | Nagai et al. | |
| 7,621,823 | B2 | 11/2009 | Beach et al. | |
| D605,715 | S | 12/2009 | Barez et al. | |
| 7,632,194 | B2 | 12/2009 | Beach et al. | |
| 7,658,686 | B2 | 2/2010 | Soracco | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| D618,746 | S | 6/2010 | Jertson et al. | |
| D618,747 | S | 6/2010 | Schweigert et al. | |
| D618,753 | S | 6/2010 | Jertson et al. | |
| D618,754 | S | 6/2010 | Schweigert et al. | |
| 7,744,484 | B1 | 6/2010 | Chao | |
| 7,798,203 | B2 | 9/2010 | Schweigert et al. | |
| 7,846,041 | B2 | 12/2010 | Beach et al. | |
| D635,626 | S | 4/2011 | Nicolette | |
| 7,927,229 | B2 | 4/2011 | Jertson et al. | |
| D638,893 | S | 5/2011 | Schweigert et al. | |
| D638,896 | S | 5/2011 | Schweigert et al. | |
| 7,963,861 | B2 | 6/2011 | Beach et al. | |
| 8,012,038 | B1 | 9/2011 | Beach et al. | |
| D647,585 | S | 10/2011 | Jertson et al. | |
| 8,096,896 | B2 | 1/2012 | De Shiell et al. | |
| D661,751 | S | 6/2012 | Nicolette et al. | |
| D661,756 | S | 6/2012 | Nicolette et al. | |
| 8,257,196 | B1 | 9/2012 | Abbott et al. | |
| 8,257,197 | B2 | 9/2012 | Schweigert | |
| 8,262,506 | B2 | 9/2012 | Watson et al. | |
| 8,287,402 | B2 | 10/2012 | De Shiell et al. | |
| D673,630 | S | 1/2013 | Schweigert | |
| D673,632 | S | 1/2013 | Schweigert et al. | |
| 8,371,957 | B2 | 2/2013 | Schweigert et al. | |
| D680,179 | S | 4/2013 | Solheim et al. | |
| 8,414,422 | B2 | 4/2013 | Peralta et al. | |
| 8,485,919 | B2 | 7/2013 | Rice et al. | |
| D691,230 | S | 10/2013 | Chen et al. | |
| 8,562,457 | B2 | 10/2013 | Beach et al. | |
| 8,608,587 | B2 | 12/2013 | Henrikson et al. | |
| 8,628,431 | B2 | 1/2014 | Schweigert et al. | |
| 8,663,026 | B2 | 3/2014 | Blowers et al. | |
| 8,777,778 | B2 | 7/2014 | Solheim et al. | |
| 8,784,232 | B2 | 7/2014 | Jertson et al. | |
| 8,790,196 | B2 | 7/2014 | Solheim et al. | |

(56) References Cited

U.S. PATENT DOCUMENTS

| | | | | |
|---|---|---|---|---|
| 8,808,108 | B2 | 8/2014 | Schweigert | |
| D712,989 | S | 9/2014 | Gillig | |
| 8,826,512 | B2 | 9/2014 | Schweigert | |
| 8,858,362 | B1 | 10/2014 | Leposky et al. | |
| 8,961,336 | B1 | 2/2015 | Parsons et al. | |
| D724,164 | S | 3/2015 | Schweigert et al. | |
| 8,979,671 | B1 * | 3/2015 | DeMille | A63B 53/0466 473/334 |
| D729,892 | S | 5/2015 | Nicolette et al. | |
| D733,234 | S | 6/2015 | Nicolette | |
| 9,199,140 | B1 | 12/2015 | Schweigert et al. | |
| 9,199,143 | B1 | 12/2015 | Parsons et al. | |
| D753,251 | S | 4/2016 | Schweigert et al. | |
| D756,471 | S | 5/2016 | Nicolette et al. | |
| 9,352,197 | B2 | 5/2016 | Parsons et al. | |
| D760,334 | S | 6/2016 | Schweigert et al. | |
| 9,399,352 | B2 | 7/2016 | Parsons et al. | |
| 9,427,634 | B2 | 8/2016 | Parsons et al. | |
| 9,452,325 | B2 | 9/2016 | De Shiell et al. | |
| 9,630,070 | B2 | 4/2017 | Parsons et al. | |
| 9,821,200 | B1 * | 11/2017 | Parsons | A63B 53/0466 |
| 9,839,821 | B2 | 12/2017 | De Shiell et al. | |
| 2006/0105856 | A1 | 5/2006 | Lo | |
| 2006/0111200 | A1 | 5/2006 | Poynor | |
| 2007/0293344 | A1 | 12/2007 | Davis | |
| 2008/0004133 | A1 | 1/2008 | Schweigert | |
| 2008/0188322 | A1 | 8/2008 | Anderson et al. | |
| 2009/0029795 | A1 | 1/2009 | Schweigert et al. | |
| 2010/0144461 | A1 | 6/2010 | Ban | |
| 2010/0167837 | A1 * | 7/2010 | Ban | A63B 53/0466 473/336 |
| 2010/0331102 | A1 | 12/2010 | Golden et al. | |
| 2011/0143858 | A1 | 6/2011 | Peralta et al. | |
| 2012/0202615 | A1 | 8/2012 | Beach et al. | |
| 2013/0303304 | A1 | 11/2013 | Sato | |
| 2015/0231454 | A1 | 8/2015 | Parsons et al. | |

OTHER PUBLICATIONS

International Search Report and Written Opinion received in connection with PCT/US15/42484 dated Oct. 19, 2015 (12 pages).

International Search Report and Written Opinion received in connection with PCT Application PCTUS2015042252 dated Oct. 13, 2015 (12 pages).

U.S. Appl. No. 29/512,313, Nicolette, "Golf Club Head," filed Dec. 18, 2014.

Wall, Jonathan, "Details: Phil's Prototype Mack Daddy PM-Grind Wedge," (http://www.pgatour.com/eguipmentreport/2015/01/21/callaway-wedge.html), www.pgatour.com, PGA Tour, Inc., published Jan. 21, 2015.

International Search Report and Written Opinion received in connection with PCT Application PCTUS201727774 dated May 15, 2017 (10 pages).

* cited by examiner

P-16-006-U03-US/30292

GOLF CLUB HEADS AND METHODS TO MANUFACTURE GOLF CLUB HEADS

CROSS REFERENCE

This application is a continuation of U.S. patent application Ser. No. 15/463,306, filed Mar. 20, 2017, now U.S. Pat. No. 9,821,200, which is a continuation of U.S. patent application Ser. No. 15/249,857, filed Aug. 29, 2016, now U.S. Pat. No. 9,630,070, which claims the benefit of U.S. Provisional Application No. 62/281,639, filed Jan. 21, 2016, U.S. Provisional Application No. 62/296,506, filed on Feb. 17, 2016, U.S. Provisional Application No. 62/301,756, filed on Mar. 1, 2016, U.S. Provisional Application No. 62/337,184, filed May 16, 2016, U.S. Provisional Application No. 62/361,988, filed Jul. 13, 2016, and U.S. Provisional Application No. 62/362,491, filed Jul. 14, 2016. U.S. patent application Ser. No. 15/249,857, filed Aug. 29, 2016, now U.S. Pat. No. 9,630,070 is a continuation-in-part of U.S. application Ser. No. 15/040,892, filed Feb. 10, 2016, now U.S. Pat. No. 9,550,096, which is a continuation-in-part application of U.S. application Ser. No. 14/939,849, filed Nov. 12, 2015, now U.S. Pat. No. 9,555,295, which is a continuation application of U.S. application Ser. No. 14/615,606, filed Feb. 6, 2015, now U.S. Pat. No. 9,199,140, which claims the benefits of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed on Jan. 19, 2015, and U.S. Provisional Application No. 62/109,510, filed Jan. 29, 2015. U.S. patent application Ser. No. 15/249,857, filed Aug. 29, 2016, now U.S. Pat. No. 9,630,070 is also a continuation-in-part application of U.S. application Ser. No. 29/559,452, filed Mar. 28, 2016, now U.S. Pat. No. D767,696, which is a continuation-in-part application of U.S. application Ser. No. 29/552,228, filed Jan. 21, 2016. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
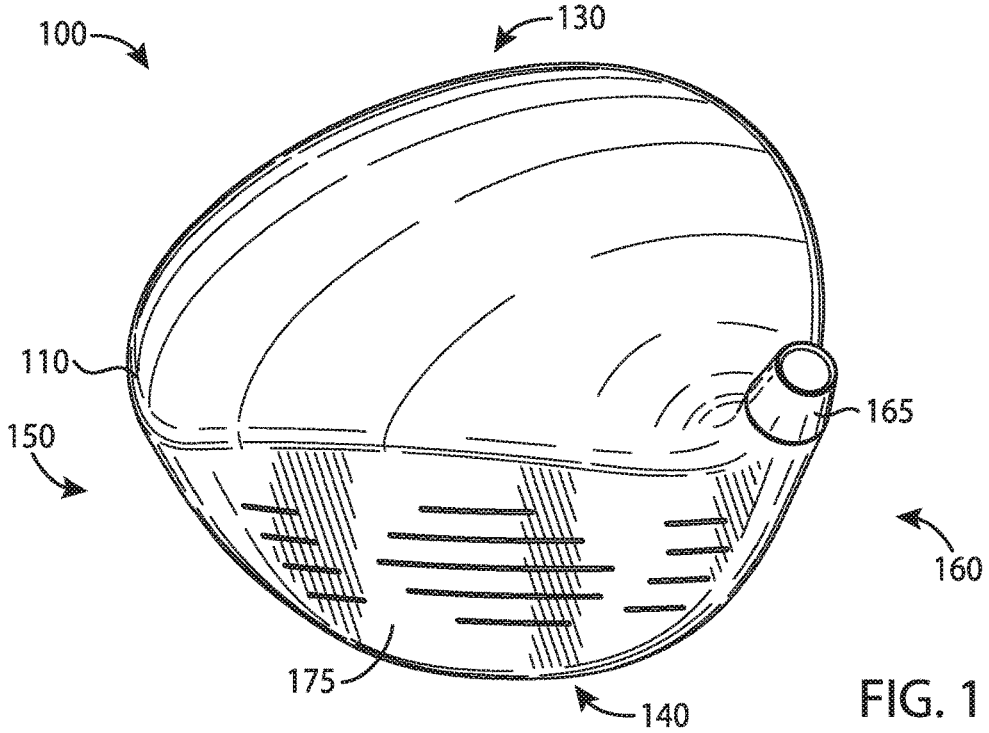
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
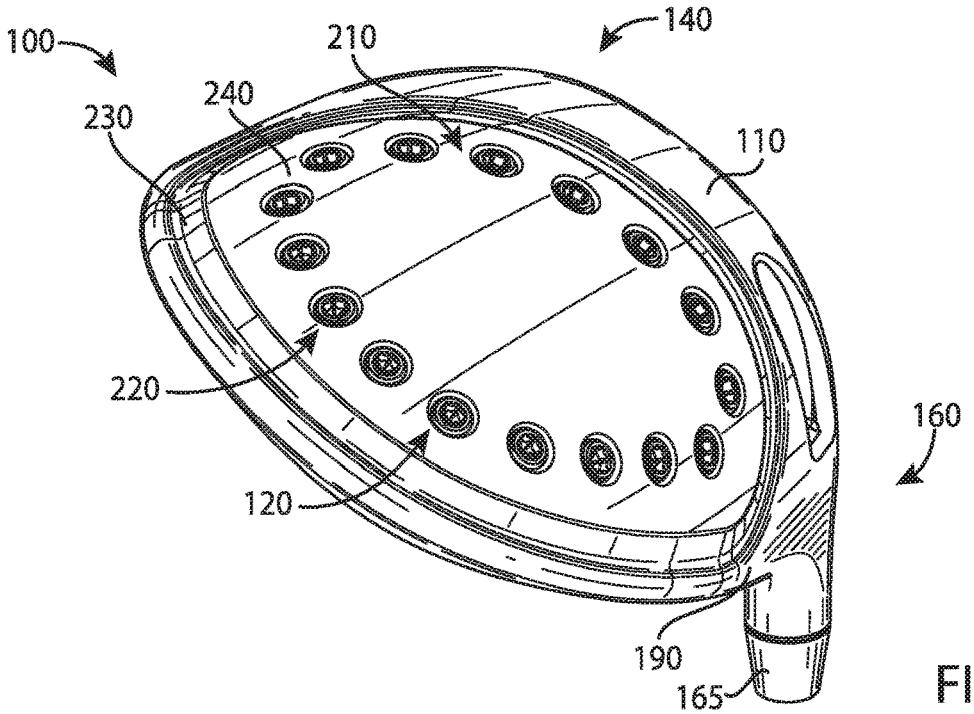
FIG. 2 depicts a bottom perspective view of the example golf club head of FIG. 1.
Figure 3:
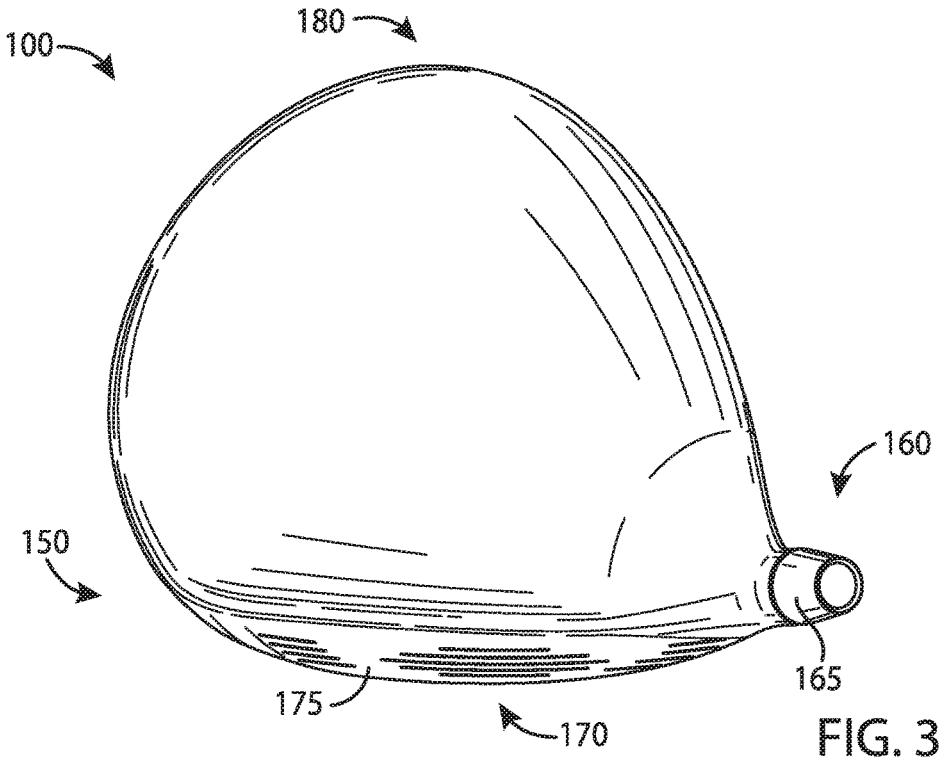
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
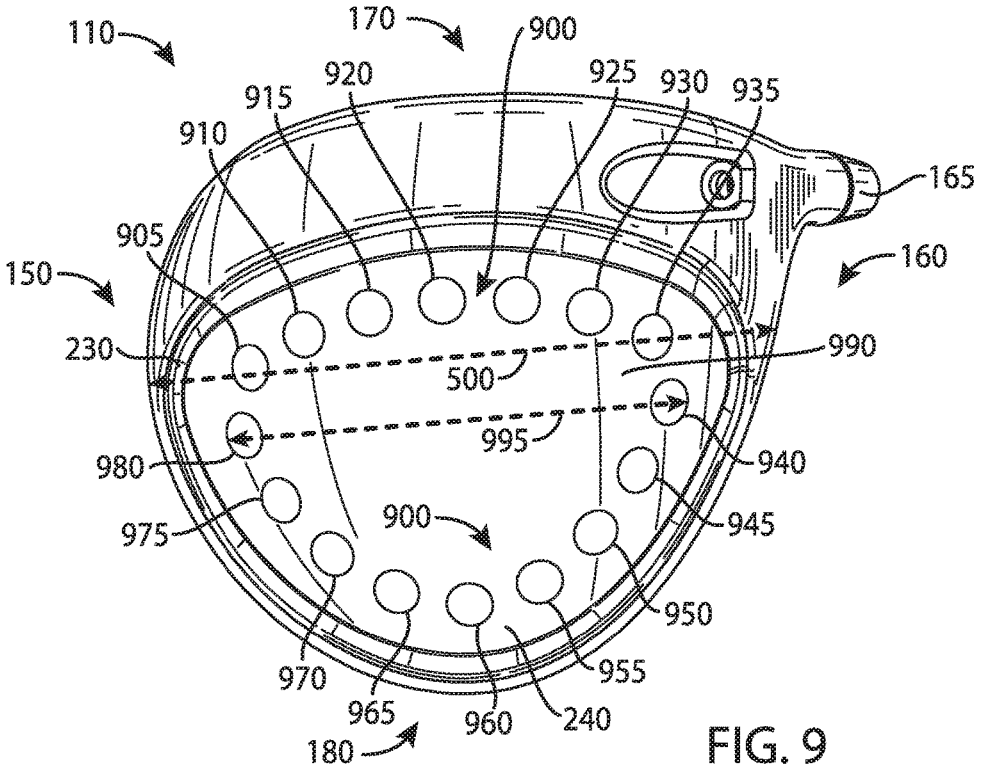
FIG. 9 depicts a bottom view of an example body portion of the example golf club head of FIG. 1.
Figure 10:
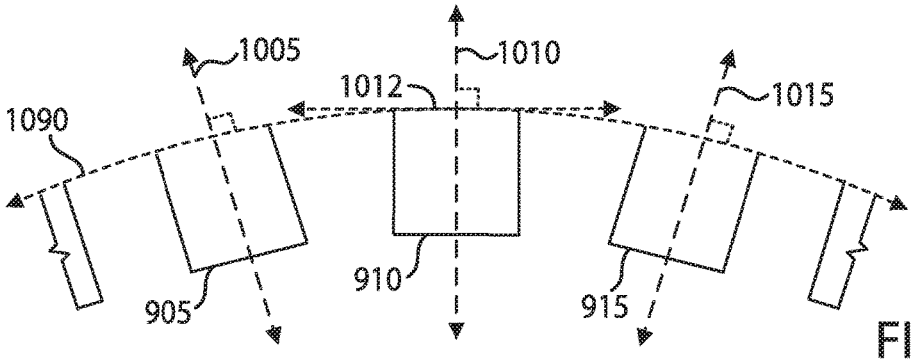
FIG. 10 depicts a cross-sectional view of the example body portion of the example golf club head of FIG. 1.
Figure 11:
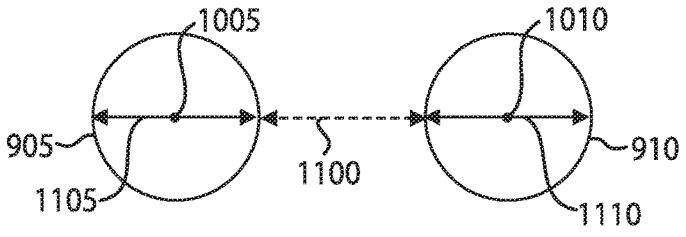
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of weight ports 900 may extend more than 50% of a maximum toe-to-heel club head distance 500 of the golf club head 100. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
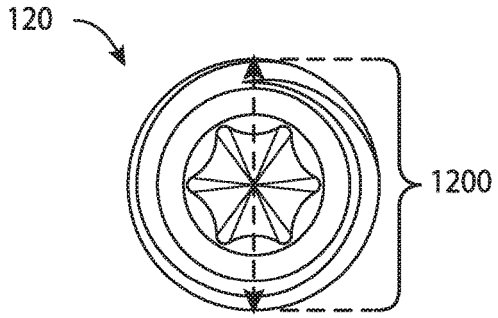
FIG. 12 depicts a top view of an example weight portion of the example golf club head of FIG. 1.
Figure 13:
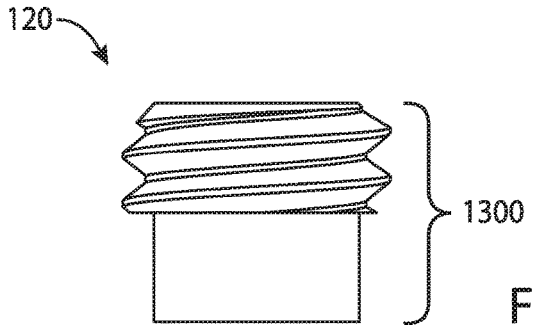
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
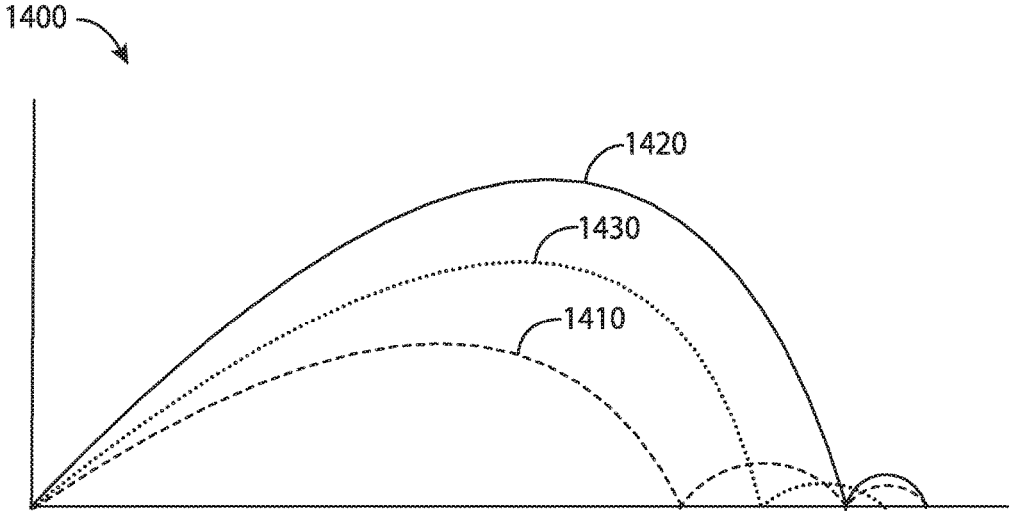
FIG. 14 depicts example launch trajectory profiles of the example golf club head of FIG. 1.
Figure 15:
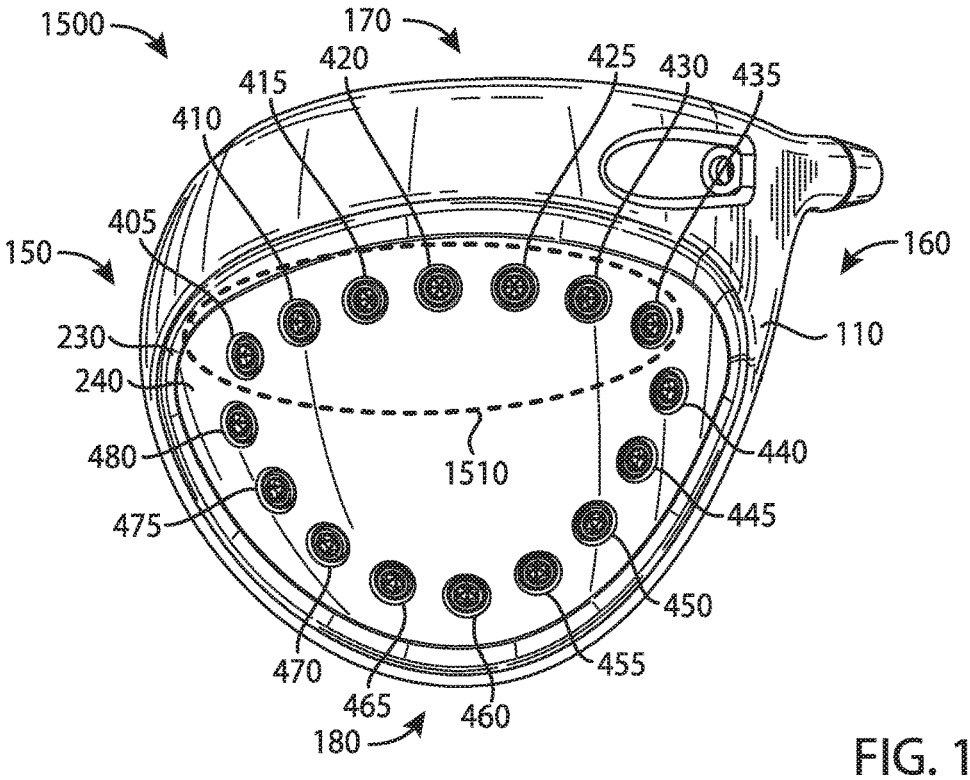
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
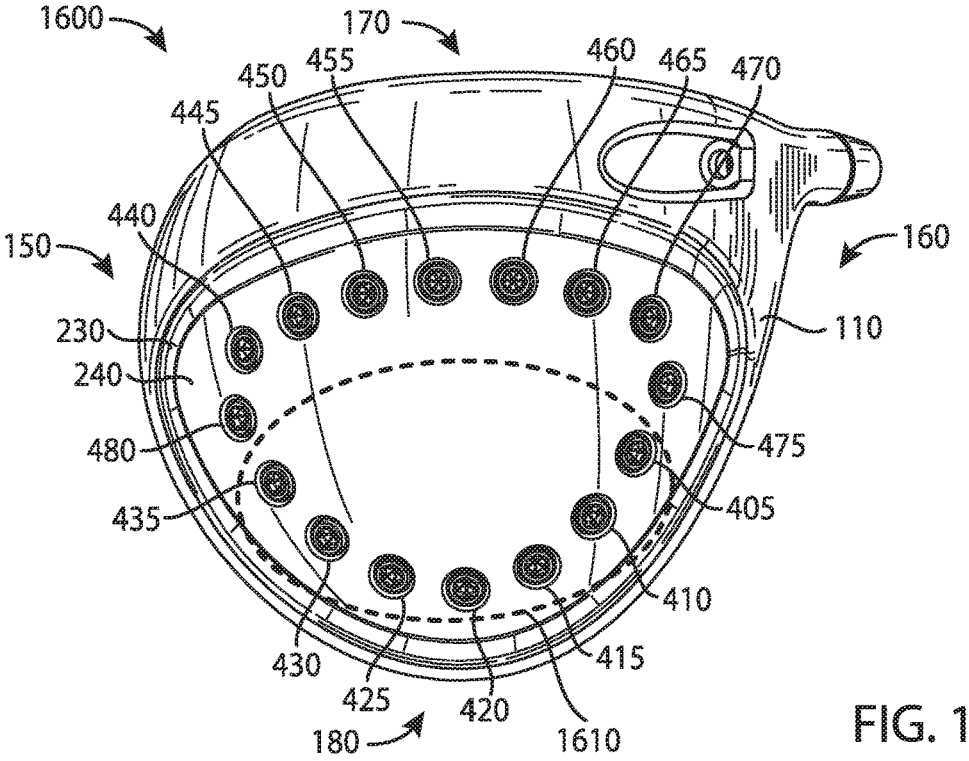
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
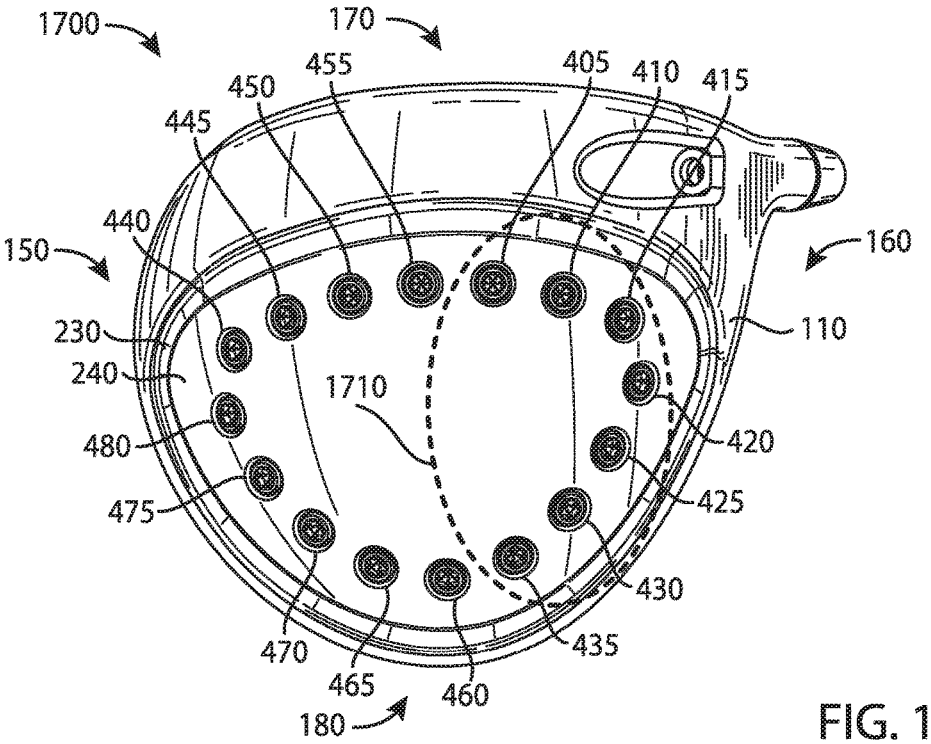
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
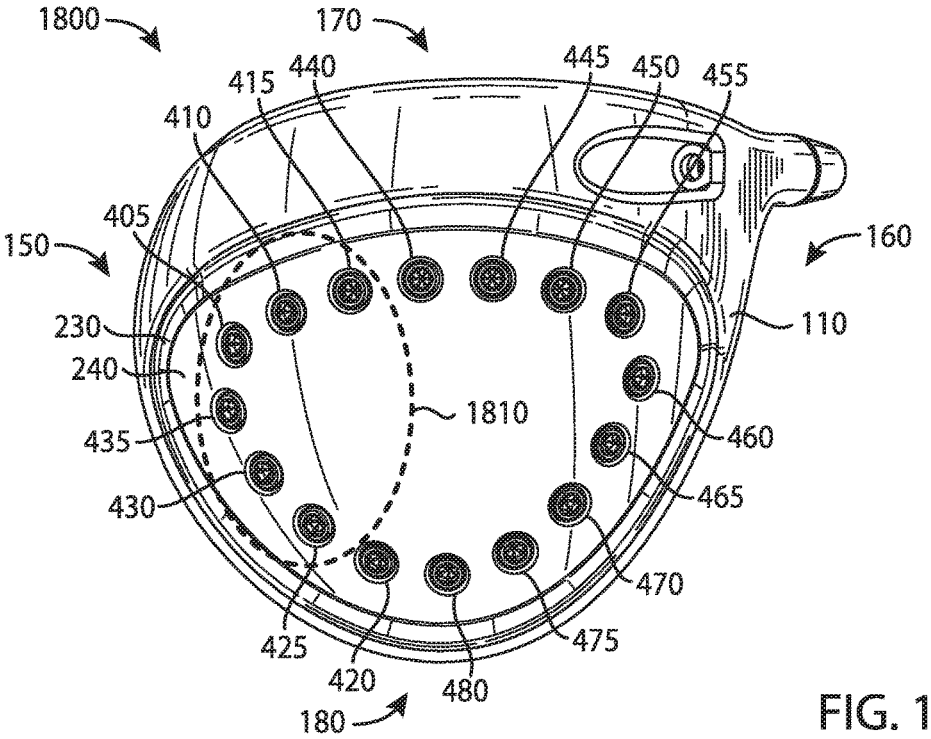
FIG. 18 depicts a fourth weight configuration of the example weight portions.
Figure 19:
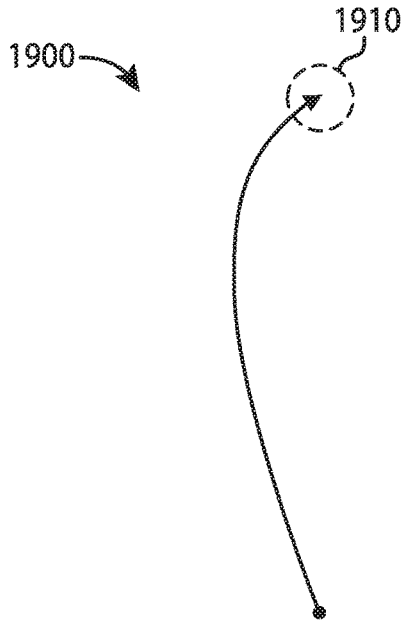
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
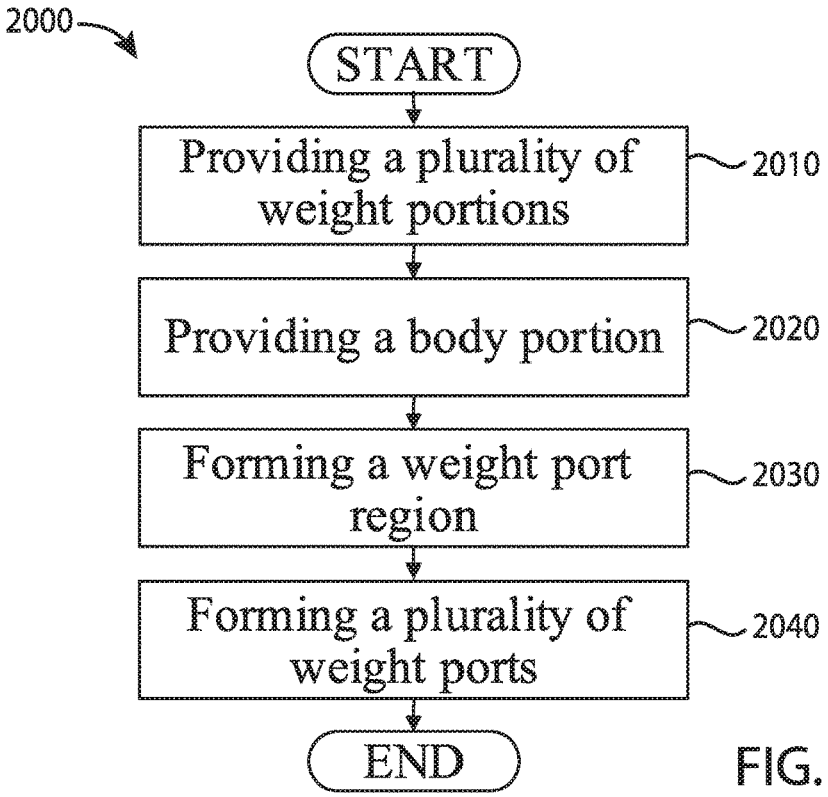
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
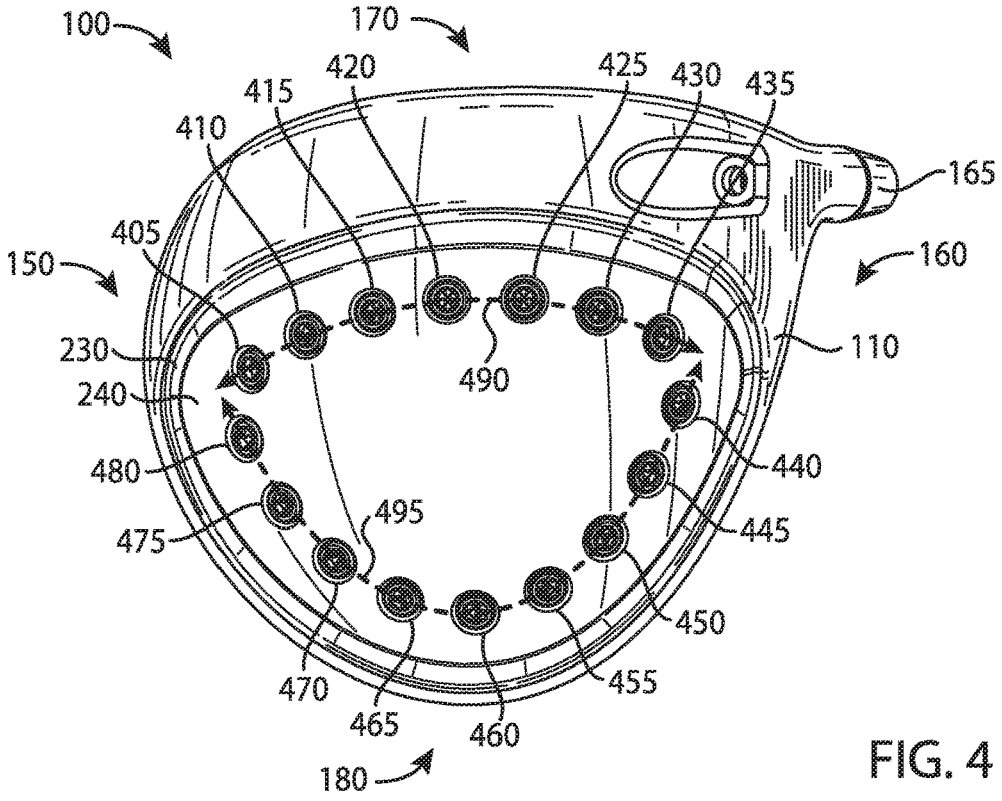
FIG. 4 depicts a bottom view of the example golf club head of FIG. 1.
Figure 5:
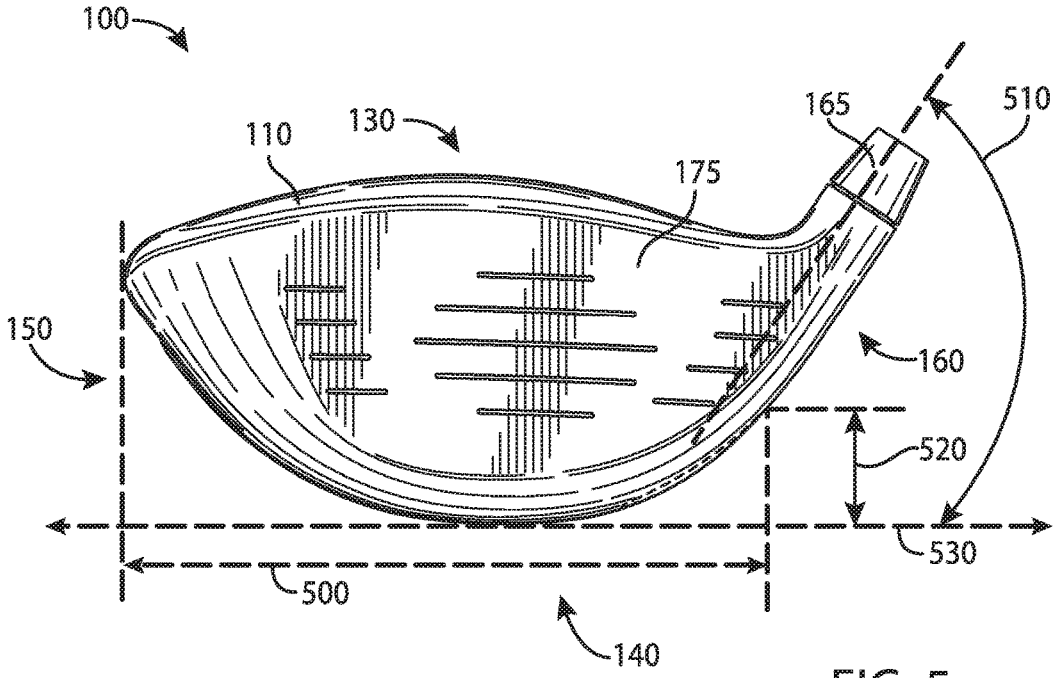
FIG. 5 depicts a front view of the example golf club head of FIG. 1.
Figure 6:
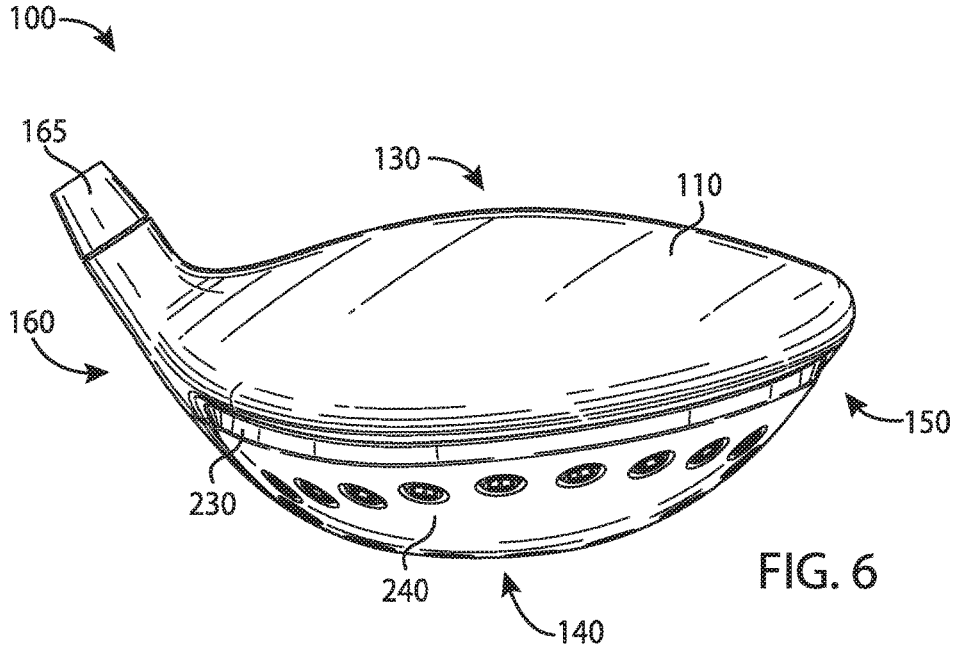
FIG. 6 depicts a rear view of the example golf club head of FIG. 1.
Figure 7:
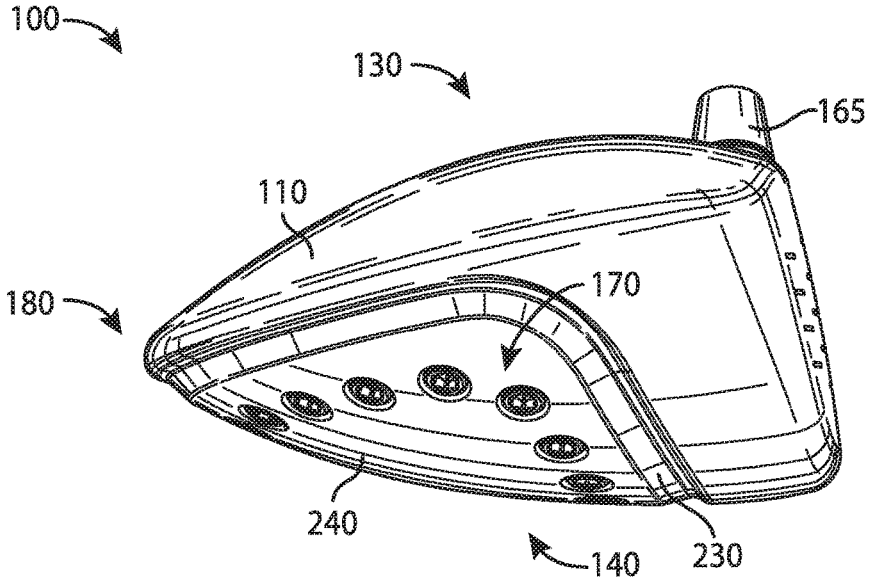
FIG. 7 depicts a toe view of the example golf club head of FIG. 1.
Figure 8:
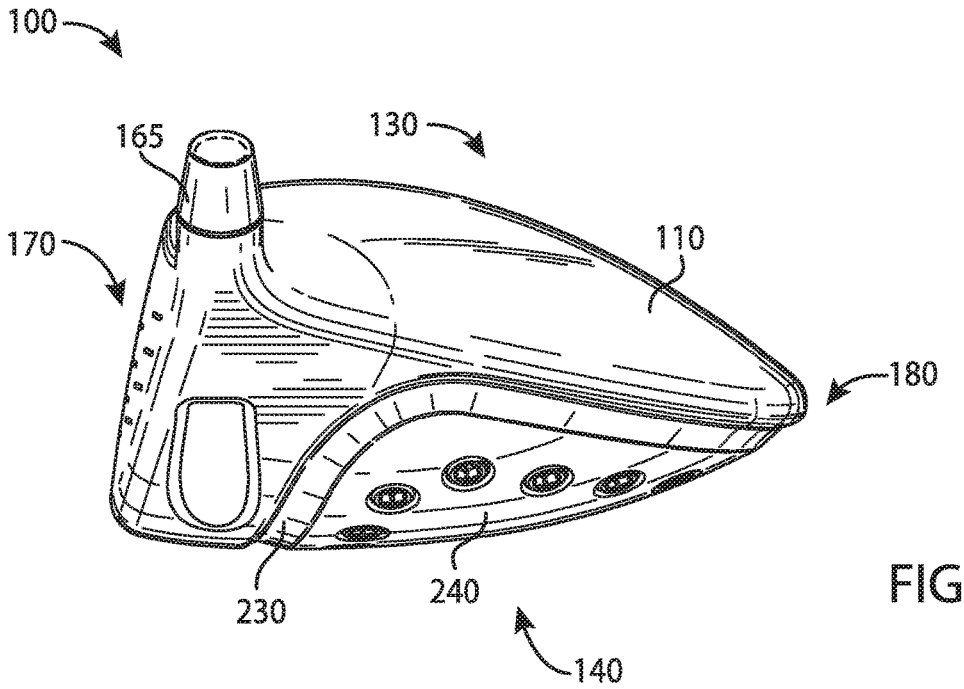
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
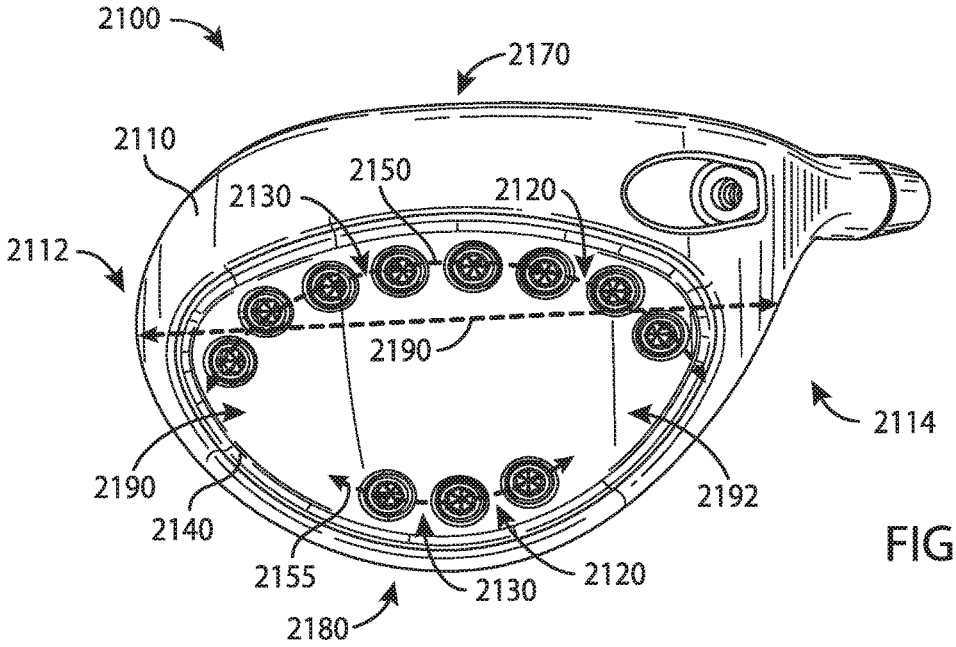
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2100, and/or a center of gravity location of the golf club head 2100.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
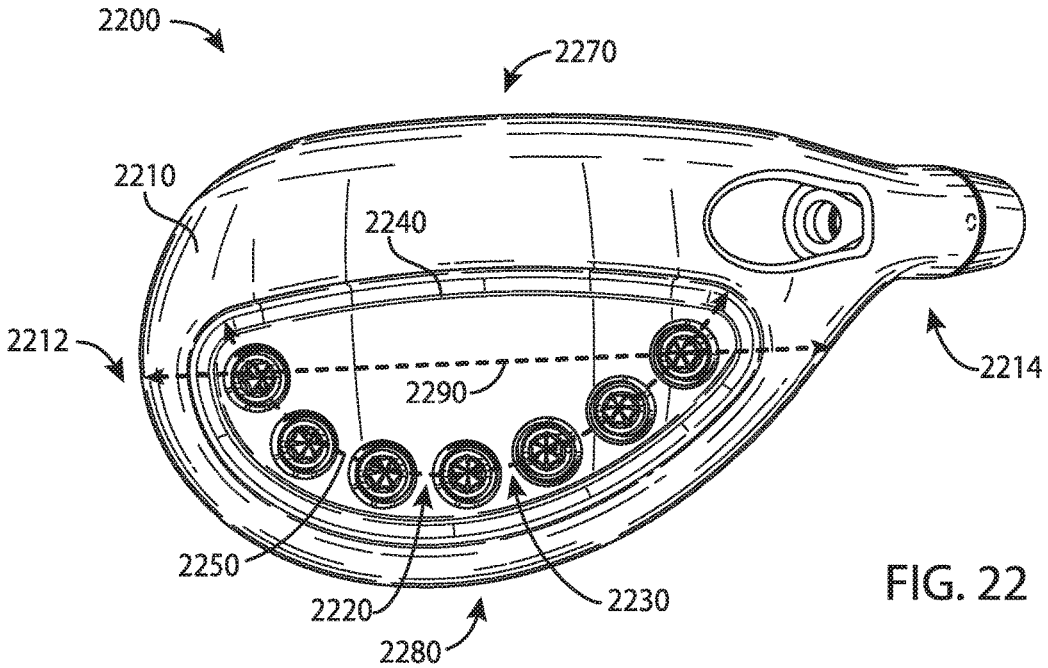
FIG. 22 depicts a bottom view of yet another example golf club head.
Figure 23:
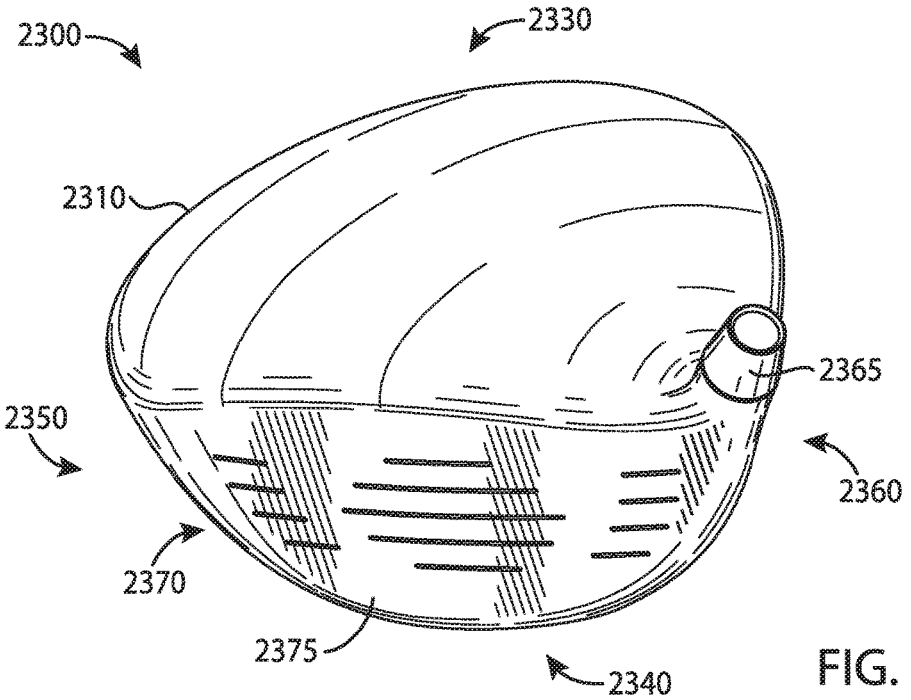
FIG. 23 is top perspective view of an example golf club head according to an embodiment of the apparatus, methods, and articles of manufacture described herein.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of weight ports 2230 in the arc 2250, the weight portions 2220 associated with each weight port 2230 and the spacing between adjacent weight ports 2230 may be determined based on the type of golf club, a preferred weight distribution of the golf club head 2200, and/or a center of gravity location of the golf club head 2200.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 24:
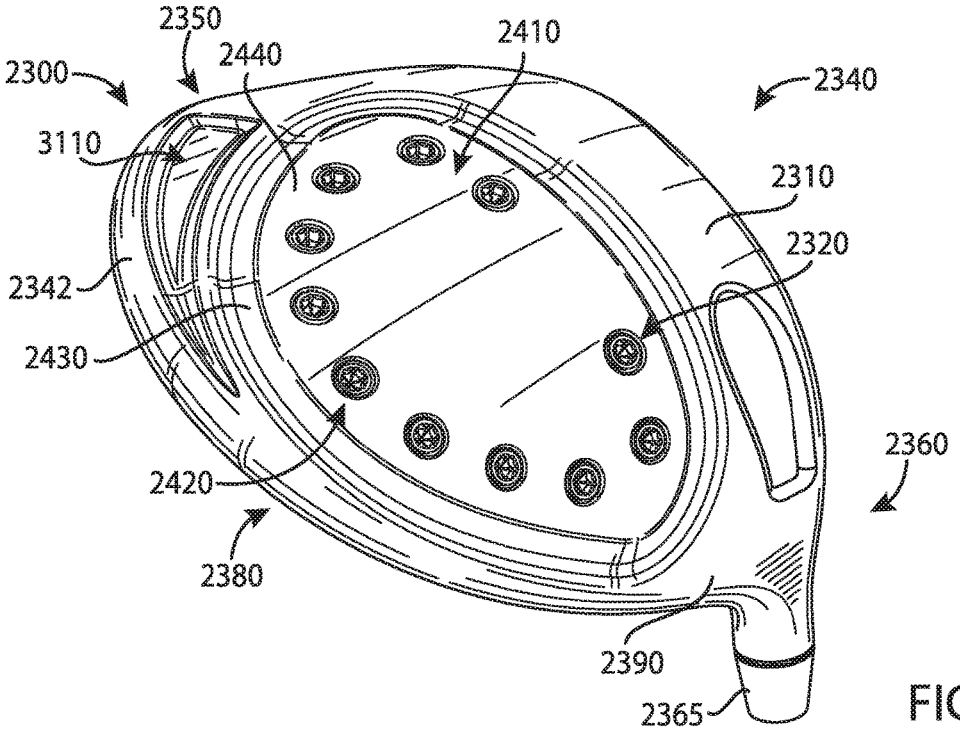
FIG. 24 depicts a bottom perspective view of the example golf club head of FIG. 23.
Figure 25:
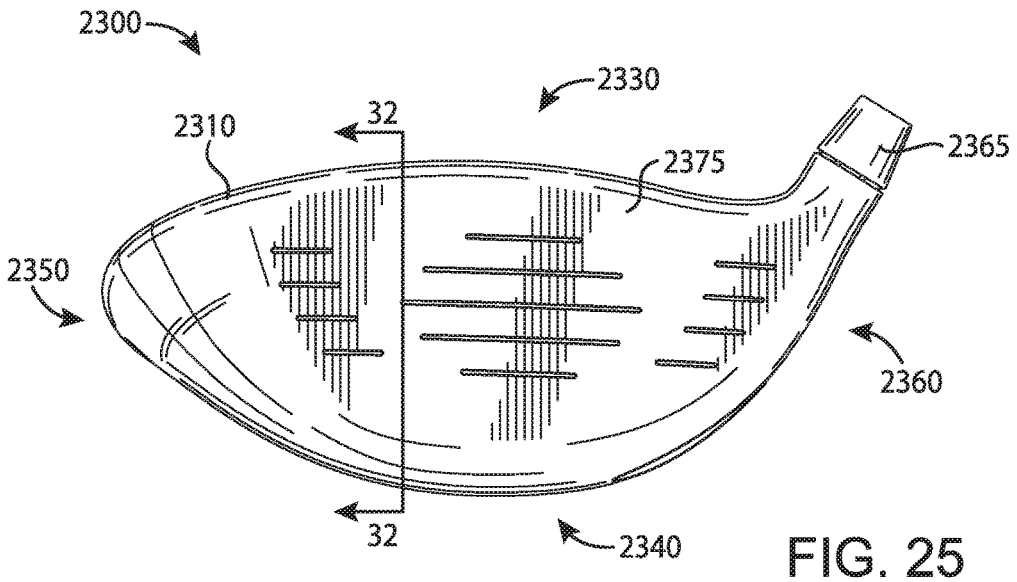
FIG. 25 depicts a front view of the example golf club head of FIG. 23.
Figure 26:
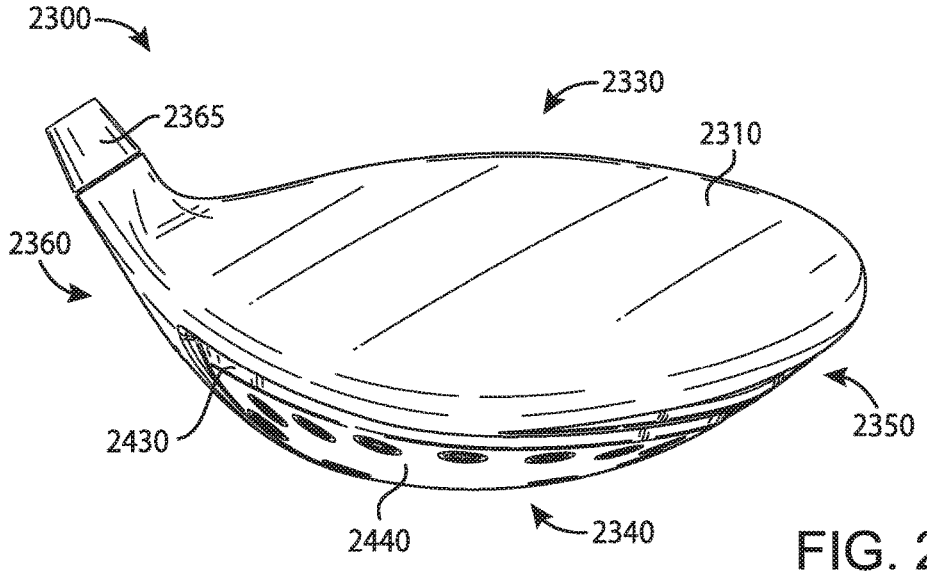
FIG. 26 depicts a rear view of the example golf club head of FIG. 23.
Figure 27:
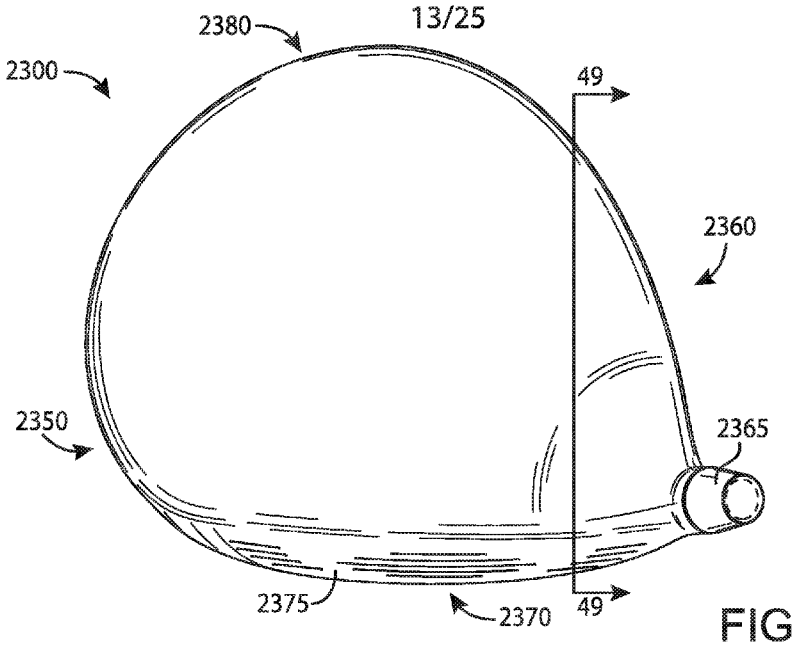
FIG. 27 depicts a top view of the example golf club head of FIG. 23.

In the example of FIGS. 23-32, a golf club head 2300 may include a body portion 2310, and a plurality of weight portions 2320 (FIG. 24), generally, shown as a first set of weight portions 2410 (FIG. 24) and a second set of weight portions 2420 (FIG. 24). The body portion 2310 may include a top portion 2330, a bottom portion 2340, a toe portion 2350, a heel portion 2360, a front portion 2370, and a rear portion 2380. The bottom portion 2340 may include a skirt portion 2390 defined as a side portion of the golf club head 2300 between the top portion 2330 and the bottom portion 2340 excluding the front portion 2370 and extending across a periphery of the golf club head 2300 from the toe portion 2350, around the rear portion 2380, and to the heel portion 2360. The bottom portion 2340 may include a transition region 2430 and a weight port region 2440. For example, the weight port region 2440 may be a D-shape region. The weight port region 2440 may include a plurality of weight ports 2800 (FIG. 28) to receive the plurality of weight portions 2320. The front portion 2370 may include a face portion 2375 to engage a golf ball (not shown). The body portion 2310 may also include a hosel portion 2365 to receive a shaft (not shown). The hosel portion 2365 may be an integral portion or a separate portion of the body portion 2310. For example, the hosel portion 2365 may include a hosel sleeve with one end to receive a shaft and an opposite end that may be inserted into the body portion 2310. Alternatively, the body portion 2310 may include a bore instead of the hosel portion 2365. For example, the body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIG. 23 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 2410, generally shown as 2605, 2610, 2615, and 2620 may be associated with a first mass. Each of the second set of weight portions 2420, generally shown as 2640, 2645, 2650, 2655, 2660, 2665, and 2670 may be associated with a second mass. The first mass may be greater than the second mass or vice versa. In one example, the first set of weight portions 2410 may be made of a tungsten-based material whereas the second set of weight portions 2420 may be made of an aluminum-based material. The first and second set of weight portions 2410 and 2420, respectively, may provide various weight configurations for the golf club head 2300 that may be similar to the various weight configurations for the golf club head 100 as described in detail herein. Alternatively, all of the weight portions of the first and second set of weight portions 2410 and 2420, respectively, may have the same mass. That is, the first and second masses may be equal to each other. The apparatus, methods, and articles of manufacture described herein are not limited in this regard.

Figure 28:
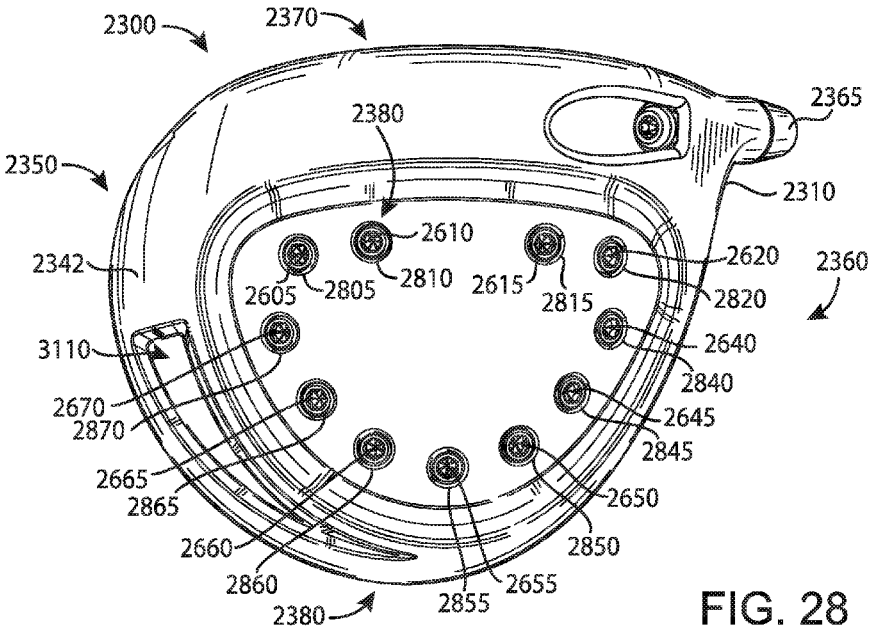
FIG. 28 depicts a bottom view of the example golf club head of FIG. 23.
Figure 29:
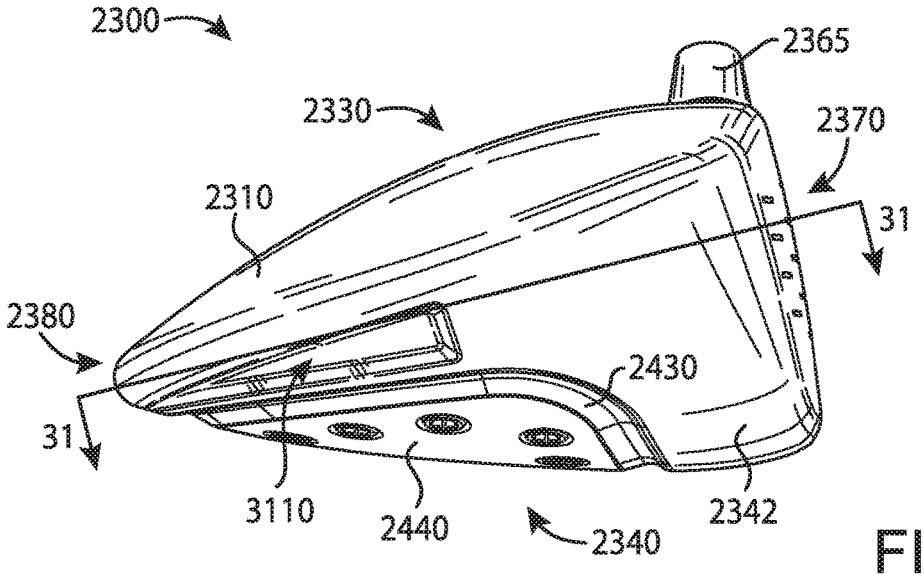
FIG. 29 depicts a toe view of the example golf club head of FIG. 23.
Figure 30:
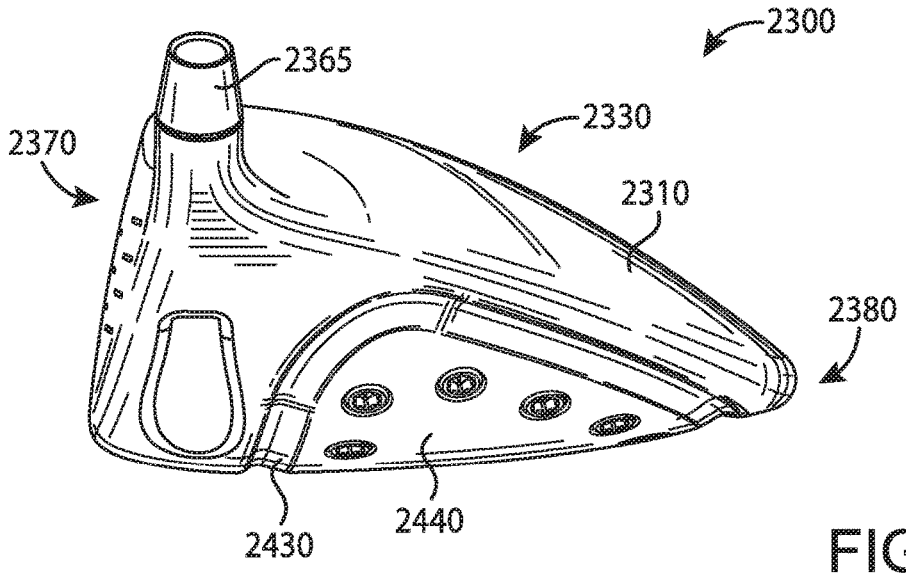
FIG. 30 depicts a heel view of the example golf club head of FIG. 1.

Referring to FIG. 28, for example, the bottom portion 2340 of the body portion 2310 may include a plurality of weight ports 2800. The plurality of weight ports 2800, generally shown as 2805, 2810, 2815, 2820, 2840, 2845, 2850, 2855, 2860, 2865, and 2870 may be located on and/or along a periphery of the weight port region 2440 of the bottom portion 2340. Each of the plurality of weight ports 2800 may be associated with a port diameter, which may be similar in many respects to the port diameters ($D_{port}$) of the weight ports 900 of the golf club head 100 (generally shown in FIG. 9). For example, the port diameter of each weight port of the plurality of weight ports 2800 may be about 0.3 inch (7.65 millimeters). Alternatively, the port diameters of adjacent weight ports of the plurality of weight ports 2800 may be different. Further, the plurality of weight ports 2800 may extend across the bottom portion 2340 similar to the configuration of the weight ports 900 of the golf club head 100 as described in detail herein. However, the configuration of the weight ports 2800 on the bottom portion 2340 may be different than the configuration of the weight ports 900 of the golf club head 100. For example, the distance between two adjacent weight ports 2800 may be less than or equal to the port diameter of any of the two adjacent weight ports, which may be similar to the weight ports 900 of the golf club head 100. However, in another example, the distance between two adjacent weight ports 2800 may be greater than the port diameter of any of two adjacent weight ports. In yet another example, the distance between two adjacent weight ports of some of the weight ports 2800 may be less than or equal to the port diameter of any of the two adjacent weight ports, while the distance between two adjacent weight ports of some of the other weight ports 2800 may be greater than the port diameter of any of the two adjacent weight ports. The apparatus, methods, and articles of manufacture described herein are not limited in this regard.

The plurality of weight ports 2800 may be formed on the bottom portion 2340 similar to the formation of the weight ports 900 of the golf club head 100. For example, a center axis of each of the weight ports 2800 may be perpendicular or substantially perpendicular to a plane tangent to an outer surface curve of the bottom portion 2340 (e.g., contour of the bottom portion 2340) at the point of intersection of the center axis and the outer surface curve as described in detail herein with respect to the golf club head 100. The apparatus, methods, and articles of manufacture described herein are not limited in this regard.

The plurality of weight portions 2320 may have similar or different physical properties (e.g., density, shape, mass, volume, size, color, etc.). The weight portions 2320 may be similar in many respects to the weight portions 120 of the golf club head 100 as described herein. The apparatus, methods, and articles of manufacture described herein are not limited in this regard.

In one example shown in FIGS. 23-32, the bottom portion 2340 may include an outer surface 2342 and an inner surface 2344. Each of the outer surface 2342 and the inner surface 2344 may include one or a plurality of support portions, generally shown as 3110, 3120, and 3140. The outer surface 2342 may include at least one outer support portion 3110 and the inner surface 2344 may include a first set of inner support portions 3120 (generally shown as inner support portions 3121, 3122, 3123, 3124, 3125, 3126, 3127, 3128, 3129, 3130, 3131, 3132 and 3133), and a second set of inner support portions 3140 (generally shown as inner support portions 3141, 3142, 3143, 3144, 3145, and 3146). The apparatus, methods, and articles of manufacture described herein are not limited in this regard.

Figure 31:
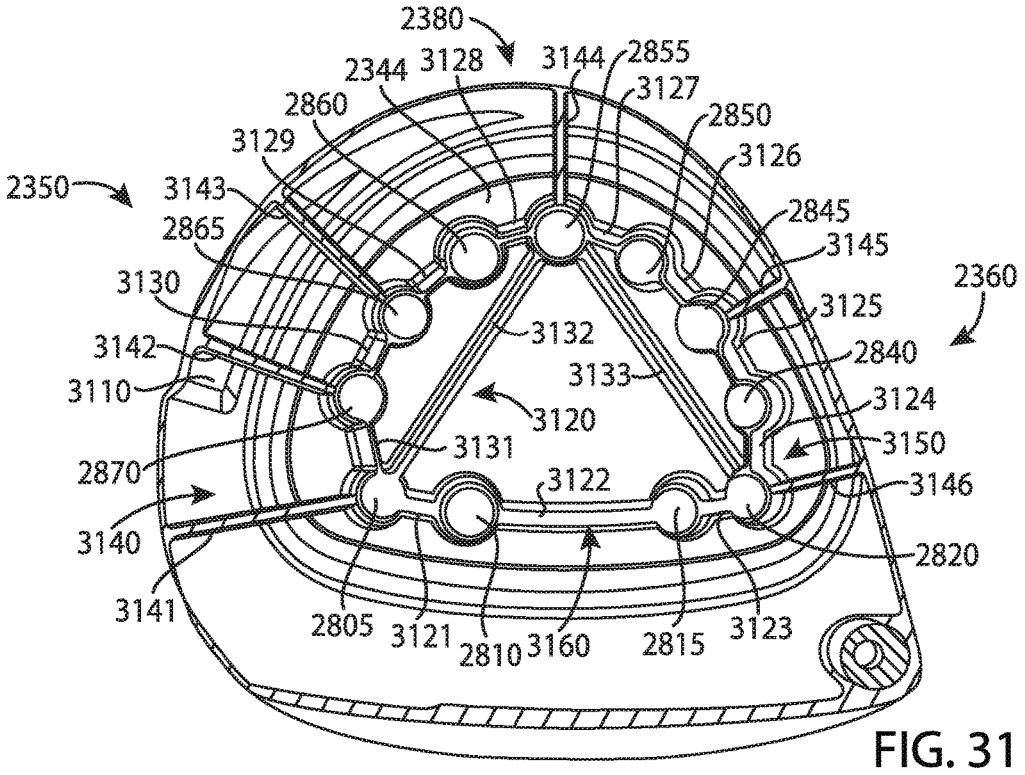
FIG. 31 depicts a cross-sectional view of the example golf club head of FIG. 23 taken at section line 31-31 of FIG. 29
Figure 32:
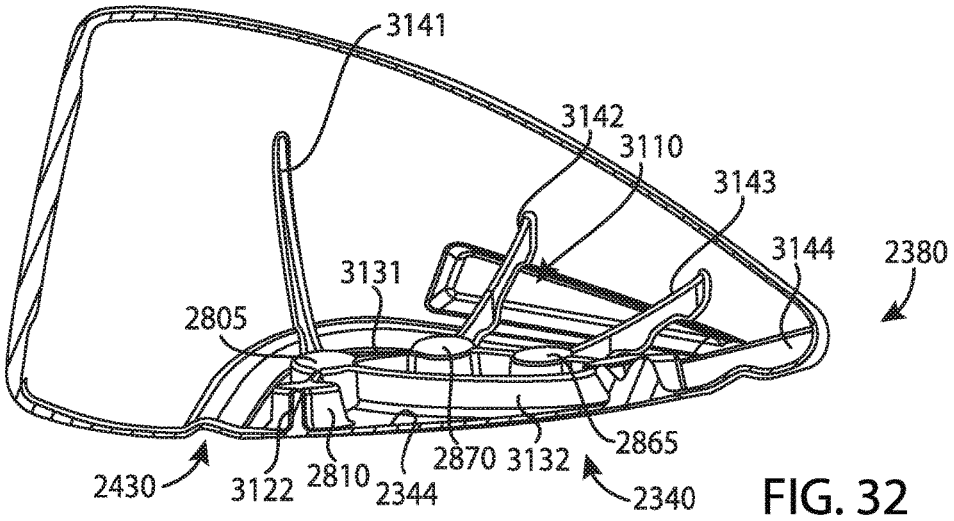
FIG. 32 depicts a cross-sectional view of the example golf club head of FIG. 23 taken at section line 32-32 of FIG. 25.
Figure 33:
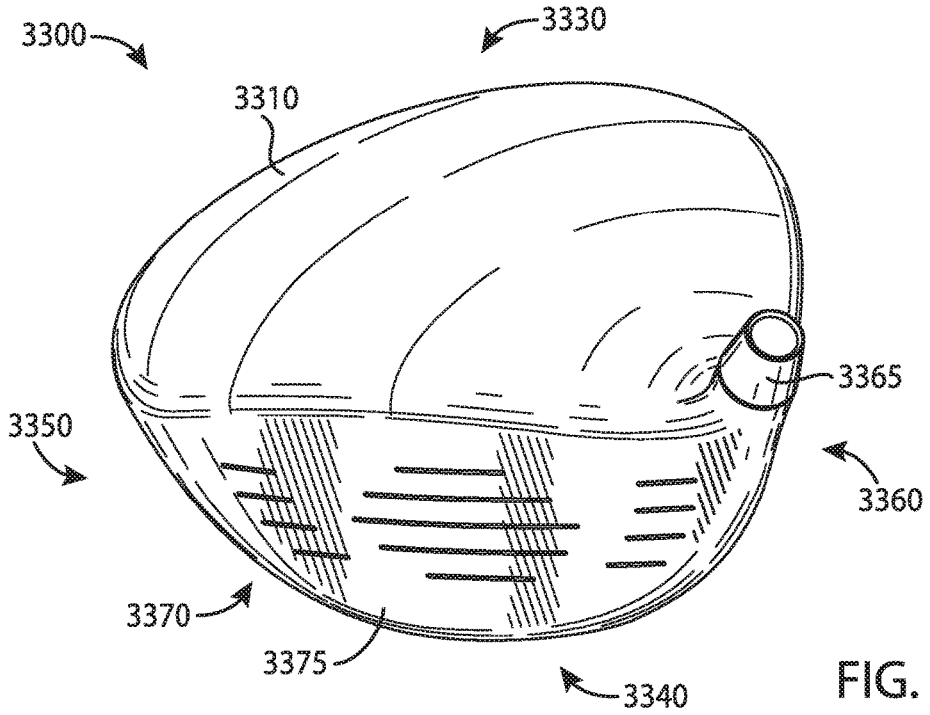
FIG. 33 is top perspective view of an example golf club head according to an embodiment of the apparatus, methods, and articles of manufacture described herein.

The outer support portion 3110 may be positioned on the bottom portion 2340 and/or the skirt portion 2390 between any of the weight ports 2800 and/or a periphery of the body portion 2310 as defined by the toe portion 2350, the heel portion 2360, the front portion 2370, and the rear portion 2380. However, the outer support portion 3110 may be positioned at any location on the golf club head 2300 for structural support of the golf club head 2300. As an example shown in FIGS. 23-32, the outer support portion 3110 may be defined by a groove or indentation that extends on the bottom portion 2340 and/or the skirt portion 2390 from the rear portion 2380 toward and/or to the toe portion 2350 proximate to a periphery of the body portion 2310. The outer support portion 3110 may have any configuration. As illustrated in FIG. 31, a width of the outer support portion 3110 may increase from the rear portion 2380 toward the toe portion 2350 while the outer support portion 3110 may follow a contour of the periphery of the body portion 2310 between the rear portion 2380 and the toe portion 2350. Accordingly, the outer support portion 3110 may resemble a curved triangular groove on the bottom portion 2340. The depth of the outer support portion 3110 may also vary. Alternatively, the depth of the outer support portion 3110 may be constant. Further, the depth of the outer support portion 3110 may be determined based on the thickness of the bottom portion 2340 and the material from which the bottom portion 2340 is formed. The apparatus, methods, and articles of manufacture described herein are not limited in this regard.

Each inner support portion of the first set of inner support portions 3120 may include walls, ribs and/or any projection from the inner surface 2344 of the bottom portion 2340. Each inner support portion of the first set of inner support portions 3120 may extend from and connect each weight port 2800 to an adjacent weight port or to one or more other non-adjacent weight ports 2800. As shown in FIG. 31, for example, the inner support portion 3121 may include a wall projecting from the inner surface 2344 of the bottom portion 2340 and connecting the weight ports 2805 and 2810. Similarly, as shown in FIG. 31, each pair of adjacent weight ports 2810 and 2815, 2815 and 2820, 2820 and 2840, 2840 and 2845, 2845 and 2850, 2850 and 2855, 2855 and 2860, 2860 and 2865, 2865 and 2870, 2870 and 2805 may be connected by inner support portions 3122, 3123, 3124, 3125, 3126, 3127, 3128, 3129, 3130, 3131, respectively. Accordingly, the inner support portions 3121 through 3131 of the first set of inner support portions 3120 may define a loop-shaped support region 3150 on the inner surface 2344 of the bottom portion 2340. The apparatus, methods, and articles of manufacture described herein are not limited in this regard.

Further, the inner support portion 3132 may include a wall projecting from the inner surface 2344 of the bottom portion 2340 and connecting two non-adjacent weight ports such as the weight ports 2805 and 2855. The inner support portion 3133 may include a wall projecting from the inner surface 2344 of the bottom portion 2340 and connecting two non-adjacent weight ports such as the weight ports 2820 and 2855. Accordingly, the inner support portions 3121, 3122, 3123, 3132 and 3133 may define a triangular support region 3160 on the inner surface 2344 of the bottom portion 2340 partially within the loop-shaped support region 3150 and partially overlapping the loop-shaped support region 3150. The weight ports 2805, 2820 and 2855 may define the vertices of the triangular support region 3160. The first set of inner support portions 3120 may have any configuration, connect any two or more of the weight ports, and/or define any shape. The apparatus, methods, and articles of manufacture described herein are not limited in this regard.

Each inner support portion of the second set of inner support portions 3140 may include walls, ribs and/or any projections on the inner surface 2344 of the bottom portion 2340. Each inner support portion of the second set of inner support portions 3140 may extend from one or more of the weight ports 2800 toward the periphery and/or the skirt portion 2390 of the body portion 2310. In one example shown in FIG. 31, the inner support portion 3141 may include a wall connected to the weight port 2805 and extending from the weight port 2805 toward and/or to the toe portion 2350. The inner support portion 3142 may include a wall connected to the weight port 2870 and extending from the weight port 2870 toward and/or to the toe portion 2350. The inner support portion 3143 may include a wall connected to the weight port 2865 and extending from the weight port 2865 toward and/or to the toe portion 2350 or the rear portion 2380. The length, height, thickness, orientation angle, and/or cross-sectional configuration of each of the inner support portions 3141, 3142 and 3143 may be configured such that the inner support portions 3141, 3142 and 3143 may provide or substantially provide structural support to the bottom portion 2340, the skirt portion 2390, the toe portion 2350, the front portion 2370 and/or the rear portion 2380. The apparatus, methods, and articles of manufacture described herein are not limited in this regard.

As illustrated in FIG. 31, the inner support portion 3144 may include a wall that may be connected to the weight port 2855 and may extend from the weight port 2855 toward and/or to the rear portion 2380. The inner support portion 3145 may include a wall connected to the weight port 2845 and extending from the weight port 2845 toward and/or to the heel portion 2360. The inner support portion 3146 may include a wall connected to the weight port 2820 and extending from the weight port 2820 toward and/or to the heel portion 2360. The length, height, thickness, orientation angle, and/or cross-sectional configuration of each of the inner support portions 3144, 3145 and 3146 may be configured such that the inner support portions 3144, 3145 and 3146 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

The first set of inner support portions 3120 may structurally support the bottom portion 2340 by distributing the impact loads exerted on the bottom portion 2340 throughout the bottom portion 2340 when the golf club head 100 strikes a golf ball (not shown). The second set of inner support portions 3140 may further distribute the impact loads throughout the bottom portion 2340, the skirt portion 2390, toe portion 2350, the heel portion 2360, the front portion 2370, and/or the rear portion 2380. In one example, the second set of inner support portions 3140 may include additional walls, ribs and/or projections (not shown) that connect to any of the weight ports such as weight ports 2840, 2850 and 2860 to further distribute impact loads throughout the body portion 2310. While the above examples may depict a particular number of inner support portions, the bottom portion 2340 may include additional inner support portions (not shown). For example, the bottom portion 2340 may include a plurality of inner support portions (not shown) that connect non-adjacent weight ports 2800 (e.g., weight ports 2815 and 2860) and/or the second set of inner support portions 3140. The apparatus, methods, and articles of manufacture described herein are not limited in this regard.

The width (i.e., thickness), length, height, orientation angle, and/or cross-sectional shape of the inner support portions of the first set of inner support portions 3120 and/or the second set of inner support portions 3140 may be similar or vary and be configured to provide structural support to the golf club head 2300. For example, the materials from which the bottom portion 2340 and/or the body portion 2310 may be constructed may determine the width, length, height, orientation angle, and/or cross-sectional shape of the inner support portions of the first set of inner support portions 3120 and/or the second set of inner support portions 3140. For example, the inner support portions of the first set of inner support portions 3120 and/or the second set of inner support portions 3140 may be defined by walls with rectangular cross sections having heights that are similar to the depths of the weight portions 2800. The length of each inner support portion of the second set of inner support portions 3140 may be configured such that one or more inner support portions of the second set of inner support portions 3140 extend from the bottom portion 2340 to the skirt portion 2390. The apparatus, methods, and articles of manufacture described herein are not limited in this regard.

Figure 34:
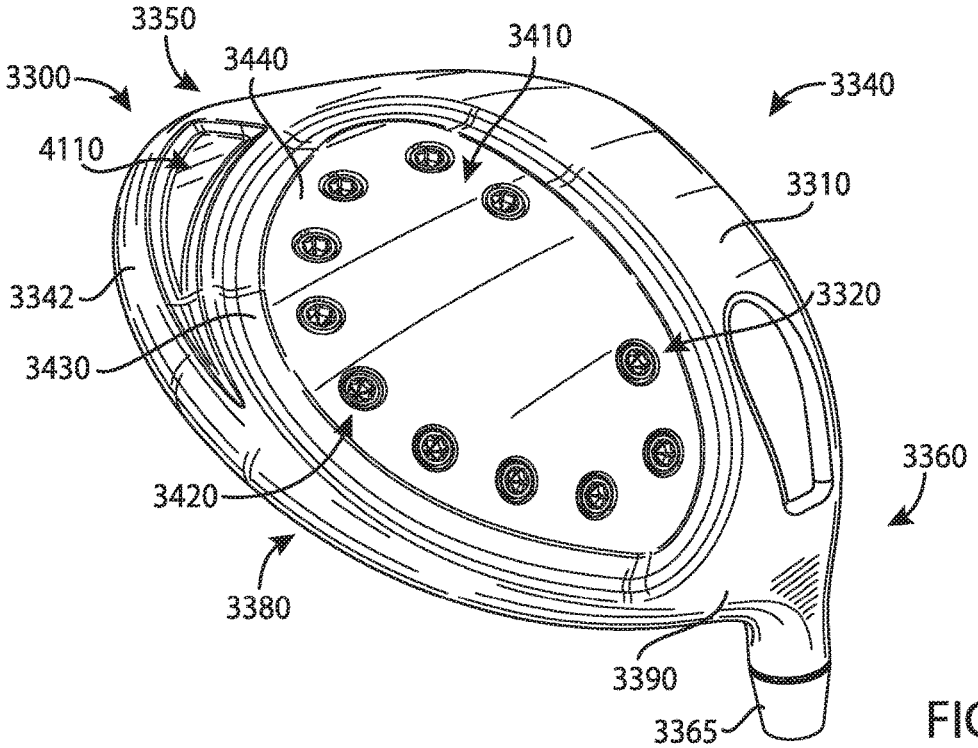
FIG. 34 depicts a bottom perspective view of the example golf club head of FIG. 33.
Figure 35:
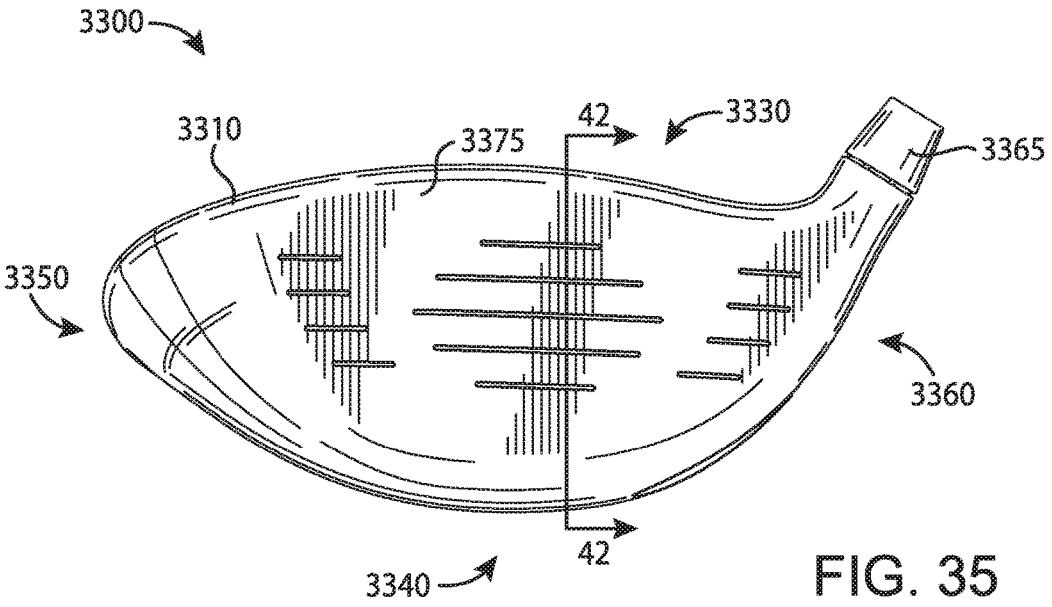
FIG. 35 depicts a front view of the example golf club head of FIG. 33.
Figure 36:
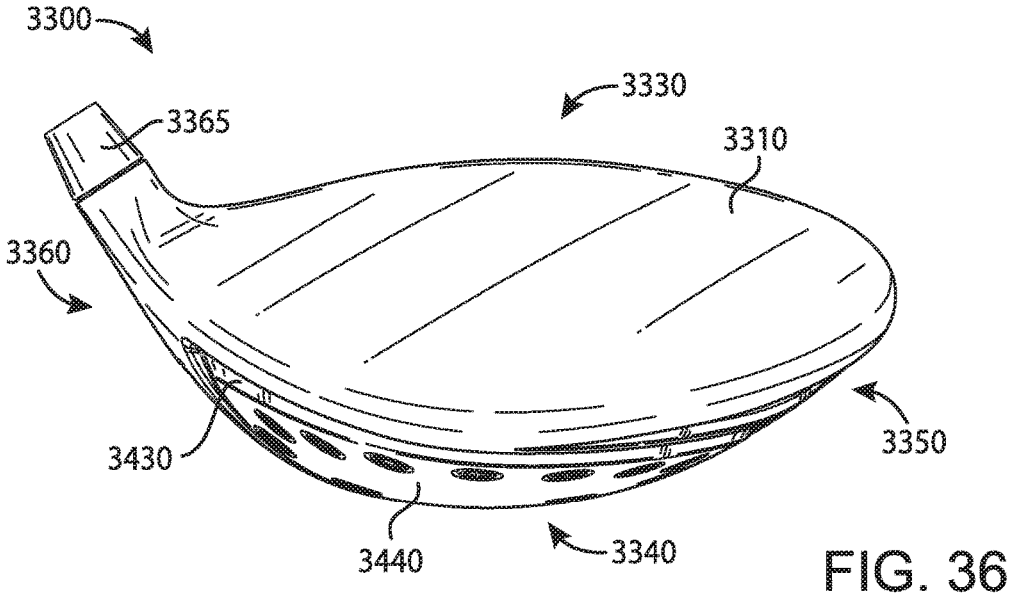
FIG. 36 depicts a rear view of the example golf club head of FIG. 33.
Figure 37:
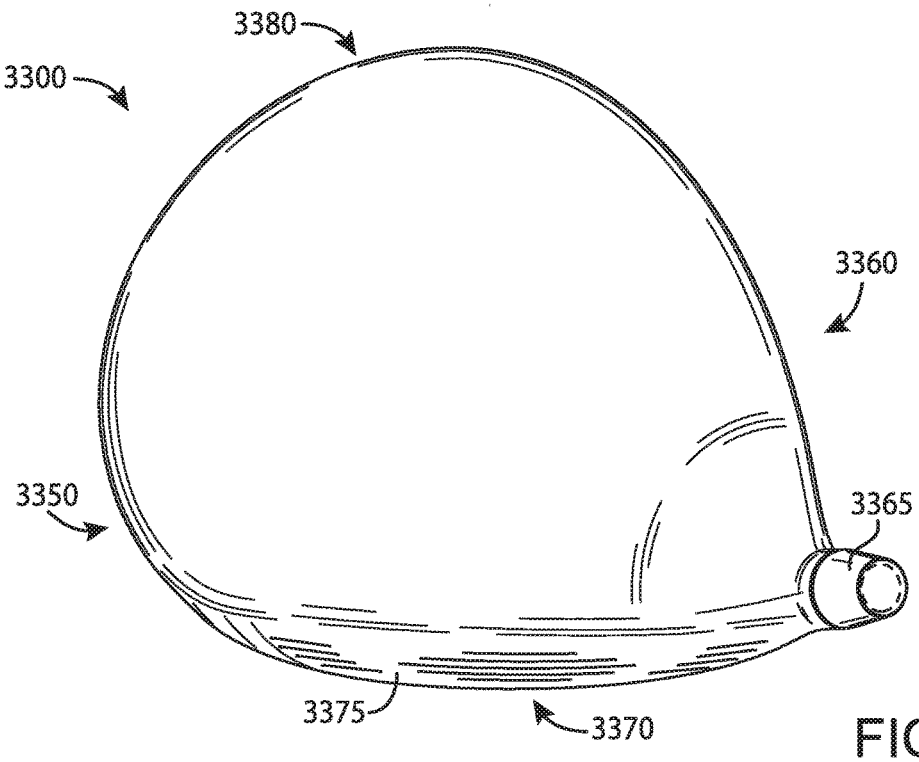
FIG. 37 depicts a top view of the example golf club head of FIG. 33.

In the example of FIGS. 33-42, a golf club head 3300 may include a body portion 3310, and a plurality of weight portions 3320 (FIG. 34), generally, shown as a first set of weight portions 3410 (FIG. 34) and a second set of weight portions 3420 (FIG. 34). The body portion 3310 may include a top portion 3330, a bottom portion 3340, a toe portion 3350, a heel portion 3360, a front portion 3370, and a rear portion 3380. The bottom portion 3340 may include a skirt portion 3390 defined as a side portion of the golf club head 3300 between the top portion 3330 and the bottom portion 3340 excluding the front portion 3370 and extending across a periphery of the golf club head 3300 from the toe portion 3350, around the rear portion 3380, and to the heel portion 3360. The bottom portion 3340 may include a transition region 3430 and a weight port region 3440. For example, the weight port region 3440 may be a D-shape region. The weight port region 3440 may include a plurality of weight ports 3800 (FIG. 38) to receive the plurality of weight portions 3320. The front portion 3370 may include a face portion 3375 to engage a golf ball (not shown). The body portion 3310 may also include a hosel portion 3365 to receive a shaft (not shown). The hosel portion 3365 may be an integral portion or a separate portion of the body portion 3310. For example, the hosel portion 3365 may include a hosel sleeve with one end to receive a shaft and an opposite end that may be inserted into the body portion 3310. Alternatively, the body portion 3310 may include a bore instead of the hosel portion 3365. For example, the body portion 3310 may be made partially or entirely of an aluminum-based material, a magnesium-type material, a steel-based material, a titanium-based material, any combination thereof, or any other suitable material. In another example the body portion 3310 may be made partially or entirely of a non-metal material such as a ceramic material, a composite material, any combination thereof, or any other suitable material.

The golf club head 3300 may have a club head volume greater than or equal to 300 cubic centimeters ($cm^3$ or cc). In one example, the golf club head 3300 may be about 460 cc. Alternatively, the golf club head 3300 may have a club head volume less than or equal to 300 cc. In particular, the golf club head 3300 may have a club head volume between 100 cc and 200 cc. The club head volume of the golf club head 3300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 3300. Although FIG. 33 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 3410, generally shown as 3605, 3610, 3615, and 3620 may be associated with a first mass. Each of the second set of weight portions 3420, generally shown as 3640, 3645, 3650, 3655, 3660, 3665, and 3670 may be associated with a second mass. The first mass may be greater than the second mass or vice versa. In one example, the first set of weight portions 3410 may be made of a tungsten-based material whereas the second set of weight portions 3420 may be made of an aluminum-based material. The first and second set of weight portions 3410 and 3420, respectively, may provide various weight configurations for the golf club head 3300 that may be similar to the various weight configurations for the golf club head 100 as described in detail herein. The apparatus, methods, and articles of manufacture described herein are not limited in this regard.

Figure 38:
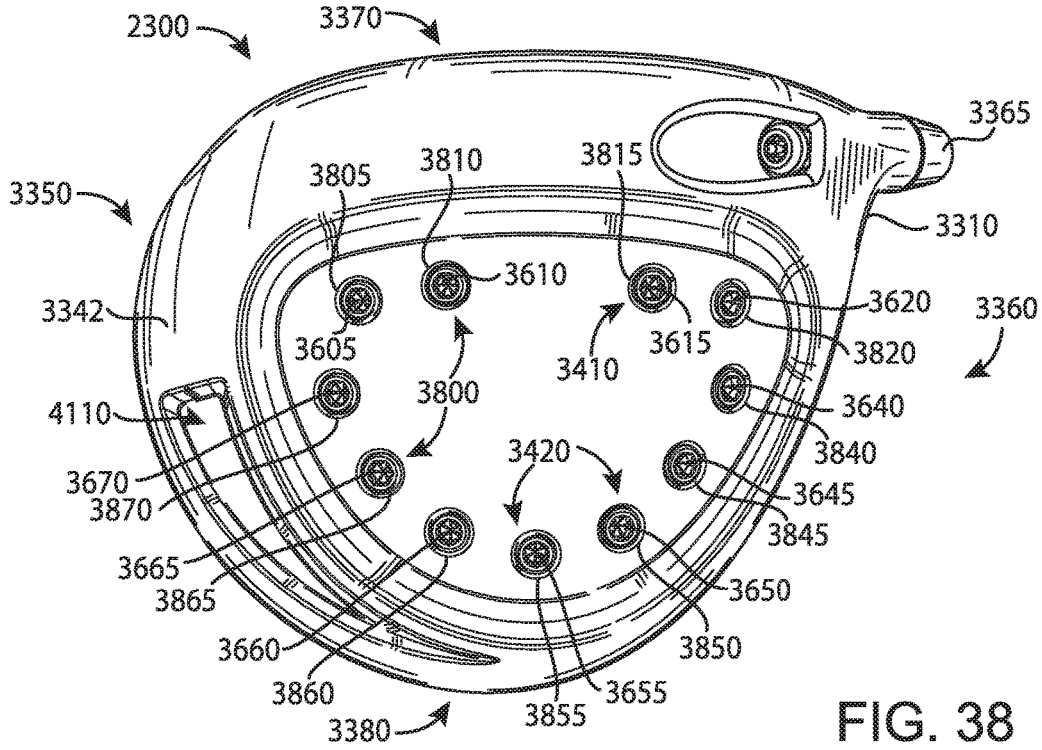
FIG. 38 depicts a bottom view of the example golf club head of FIG. 33.
Figure 39:
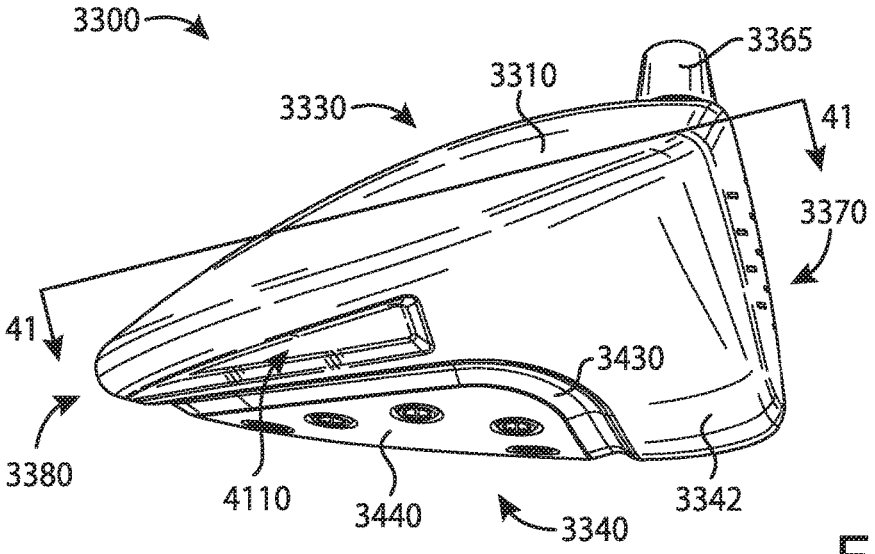
FIG. 39 depicts a toe view of the example golf club head of FIG. 33.
Figure 40:
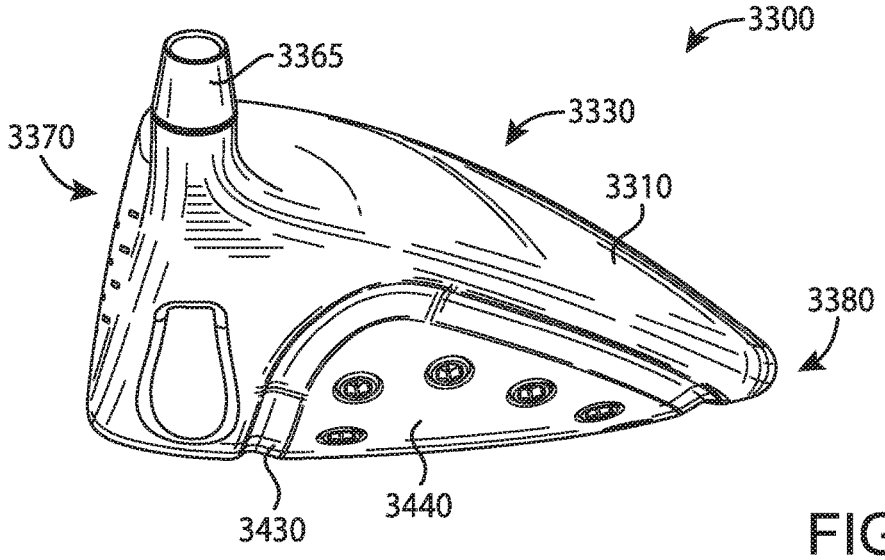
FIG. 40 depicts a heel view of the example golf club head of FIG. 33.

Referring to FIG. 38, for example, the bottom portion 3340 of the body portion 3310 may include a plurality of weight ports 3800. The plurality of weight ports 3800, generally shown as 3805, 3810, 3815, 3820, 3840, 3845, 3850, 3855, 3860, 3865, and 3870 may be located on and/or along a periphery of the weight port region 3440 of the bottom portion 3340. Each of the plurality of weight ports 3800 may be associated with a port diameter, which may be similar in many respects to the port diameters ($D_{port}$) of the weight ports 900 of the golf club head 100 (generally shown in FIG. 9). For example, the port diameter of each weight port of the plurality of weight ports 3800 may be about 0.3 inch (7.65 millimeters). Alternatively, the port diameters of adjacent weight ports of the plurality of weigh ports 3800 may be different. Further, the plurality of weight ports 3800 may extend across the bottom portion 3340 similar to the configuration of the weight ports 900 of the golf club head 100 as described in detail herein. However, the configuration of the weight ports 3800 on the bottom portion 3340 may be different than the configuration of the weight ports 900 of the golf club head 100. For example, the distance between two adjacent weight ports 3800 may be less than or equal to the port diameter of any of the two adjacent weight ports, which may be similar to the weight ports 900 of the golf club head 100. However, in another example, the distance between two adjacent weight ports 3800 may be greater than the port diameter of any of two adjacent weight ports. In another example, the distance between two adjacent weight ports of some of the weight ports 3800 may be less than or equal to the port diameter of any of the two adjacent weight ports, while the distance between two adjacent weight ports of some of the other weight ports 3800 may be greater than the port diameter of any of the two adjacent weight ports. The apparatus, methods, and articles of manufacture described herein are not limited in this regard.

The plurality of weight ports 3800 may be formed on the bottom portion 3340 similar to the formation of the weight ports 900 of the golf club head 100. For example, a center axis of each of the weight ports 3800 may be perpendicular or substantially perpendicular to a plane tangent to an outer surface curve 3340 (e.g., contour of the bottom portion 3340) at the point of intersection of the center axis and the outer surface curve as described in detail herein with respect to the golf club head 100. The apparatus, methods, and articles of manufacture described herein are not limited in this regard.

The plurality of weight portions 3320 may have similar or different physical properties (e.g., density, shape, mass, volume, size, color, etc.). The weight portions 3320 may be similar in many respects to the weight portions 120 of the golf club head 100 as described herein. The apparatus, methods, and articles of manufacture described herein are not limited in this regard.

Figure 41:
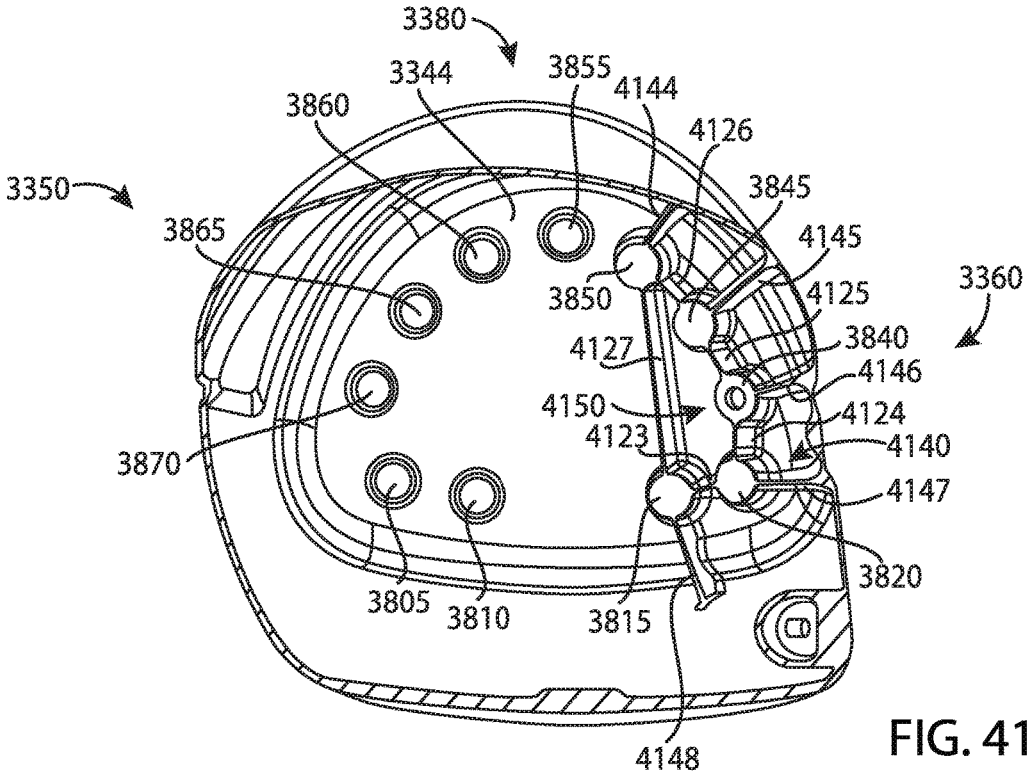
FIG. 41 depicts a cross-sectional view of the example golf club head of FIG. 33 taken at section line 41-41 of FIG. 39
Figure 42:
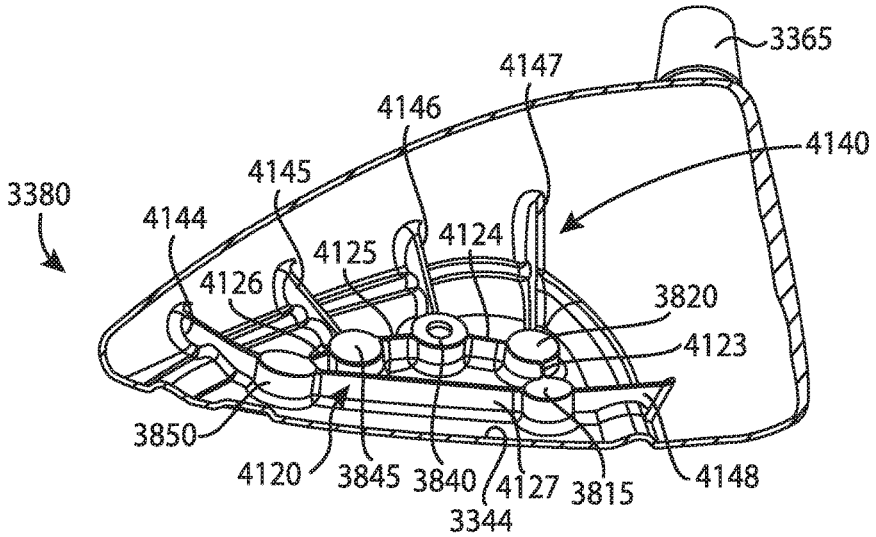
FIG. 42 depicts a cross-sectional view of the example golf club head of FIG. 33 taken at section line 42-42 of FIG. 35.

In one example shown in FIGS. 33-42, the bottom portion 3340 may include an outer surface 3342 and an inner surface 3344. Each of the outer surface 3342 and the inner surface 3344 may include one or a plurality of support portions, generally shown as 4110, 4120, 4140. The outer surface 3342 may include at least one outer support portion 4110 and the inner surface 3344 may include a first set of inner support portions 4120 (generally shown as inner support portions 4123, 4124, 4125, 4126, and 4127), and a second set of inner support portions 4140 (generally shown as inner support portions 4144, 4145, 4146, 4147 and 4148). The first set of inner support portions 4120 and the second set of inner support portions 4140 may be located at any one location or multiple locations on the body portion 3310. As illustrated in FIGS. 41 and 42, the first set of inner support portions 4120 and the second set of inner support portions 4140 are closer to the heel portion 3360 than to the toe portion 3350. For example, the first set of inner support portions 4120 and the second set of inner support portions 4140 may be located on the bottom portion 3340 between a midpoint of the body portion 3310 and the heel portion 3360. The apparatus, methods, and articles of manufacture described herein are not limited in this regard.

The outer support portion 4110 may be positioned on the bottom portion 3340 and/or the skirt portion 3390 between any of the weight ports 3800 and/or a periphery of the body portion 3310 as defined by the toe portion 3350, the heel portion 3360, the front portion 3370, and the rear portion 3380. However, the outer support portion 4110 may be positioned at any location on the golf club head 3300 for structural support of the golf club head 3300. In one example shown in FIGS. 33-42, the outer support portion 4110 may be defined by a groove or indentation that extends on the bottom portion 3340 and/or the skirt portion 3390 from the rear portion 3380 toward and/or to the toe portion 3350 proximate to a periphery of the body portion 3310. The outer support portion 4110 may have any configuration. As illustrated in FIG. 41, a width of the outer support portion 4110 may increase from the rear portion 3380 toward and/or to the toe portion 3350 while the outer support portion 4110 may follow a contour of the periphery of the body portion 3310 between the rear portion 3380 and the toe portion 3350. Accordingly, the outer support portion 4110 may resemble a curved triangular groove on the bottom portion 3340. The depth of the outer support portion 4110 may also vary. Further, the depth of the outer support portions 4110 may be determined based on the thickness of the bottom portion 3340 and the material from which the bottom portion 3340 may be formed. The apparatus, methods, and articles of manufacture described herein are not limited in this regard.

Each inner support portion of the first set of inner support portions 4120 may include walls, ribs and/or any projection from the inner surface 3344 of the bottom portion 3340. Each inner support portion of the first set of inner support portions 4120 may extend from one or more of the weight ports 3800 and connect two or more adjacent and/or non-adjacent weight ports 3800. As shown in FIG. 41, for example, the inner support portion 4123 may include a wall projecting from the inner surface 3344 of the bottom portion 3340 and connecting the weight ports 3815 and 3820. Similarly, each pair of adjacent weight ports 3815 and 3820, 3820 and 3840, 3840 and 3845, 3845 and 3850, and 3850 and 3815 may be connected by inner support portions 4123, 4124, 4125, 4126, and 4127, respectively. Accordingly, the inner support portions 4123 through 4127 of the first set of inner support portions 4120 may define a loop-shaped support region 4150 on the inner surface 3344 of the bottom portion 3340. The loop-shaped support region 4150 may be closer to the heel portion 3360 than to the toe portion 3350. Referring to FIGS. 41 and 42, for example, the loop-shaped support region 4150 may be located between a midpoint of the body portion 3310 and the heel portion 3360. The apparatus, methods, and articles of manufacture described herein are not limited in this regard.

Each inner support portion of the second set of inner support portions 4140 may include walls, ribs and/or any projections on the inner surface 3344 of the bottom portion 3340. Each inner support portion of the second set of inner support portions 4140 may extend from one or more of the weight ports 3800 toward the periphery and/or the skirt portion 3390 of the body portion 3310. Turning back to FIG. 41, for example, the inner support portion 4144 may include a wall connected to the weight port 3850 and extending from the weight port 3850 toward and/or to the rear portion 3380. The inner support portion 4145 may include a wall connected to the weight port 3845 and extending from the weight port 3845 toward and/or to the heel portion 3360. The inner support portion 4146 may include a wall connected to the weight port 3840 and extending from the weight port 3840 toward and/or to the heel portion 3360. The inner support portion 4147 may include a wall connected to the weight port 3820 and extending from the weight port 3820 toward and/or to the heel portion 3360. The inner support portion 4148 may include a wall connected to the weight port 3815 and extending from the weight port 3815 toward and/or to the front portion 3370. The length, height, thickness, orientation angle, and/or cross-sectional configuration of each of the inner support portions 4144, 4145, 4146, 4147 and 4148 may be configured such that the inner support portions 4144, 4145, 4146, 4147 and 4148 may provide or substantially provide structural support to the bottom portion 3340, the skirt portion 3390, the heel portion 3360, the front portion 3370 and/or the rear portion 3380. The apparatus, methods, and articles of manufacture described herein are not limited in this regard.

The first set of inner support portions 4120 may structurally support the bottom portion 3340 by distributing the impact loads exerted on the bottom portion 3340 throughout the bottom portion 3340 when the golf club head 100 strikes a golf ball (not shown). The second set of inner support portions 4140 may further distribute the impact loads throughout the bottom portion 3340, the skirt portion 3390, toe portion 3350, the heel portion 3360, the front portion 3370, and/or the rear portion 3380. In one example, the second set of inner support portions 4140 may include additional walls, ribs and/or projections (not shown) that connect to any of the weight ports to further distribute impact loads throughout the body portion 3310. While the above examples may depict a particular number of inner support portions, the bottom portion 3340 may include more or less inner support portions. For example, the bottom portion 3340 may include a plurality of inner support portions (not shown) that connect non-adjacent weight ports 3800 (e.g., weight ports 3815 and 3840) and/or the second set of inner support portions 4140. The apparatus, methods, and articles of manufacture described herein are not limited in this regard.

The width (i.e., thickness), length, height, orientation angle, and/or cross-sectional shape of each inner support portion of the first set of inner support portions 4120 and/or the second set of inner support portions 4140 may be similar or vary and be configured to provide structural support to the golf club head 3300. For example, the materials from which the bottom portion 3340 and/or the body portion 3310 may be constructed may determine the width, length, height, orientation angle, and/or cross-sectional shape of each of the inner support portions of the first set of inner support portions 4120 and/or the second set of inner support portions 4140. For example, the inner support portions of the first set of inner support portions 4120 and/or the second set of inner support portions 4140 may be defined by walls with rectangular cross sections having heights that are similar to the depths of the weight portions 3800. The length of each inner support portion of the second set of inner support portions 4140 may be configured such that one or more of the inner support portions of the second set of inner support portions 4140 extend from the bottom portion 3340 to the skirt portion 3390. The apparatus, methods, and articles of manufacture described herein are not limited in this regard.

Figure 43:
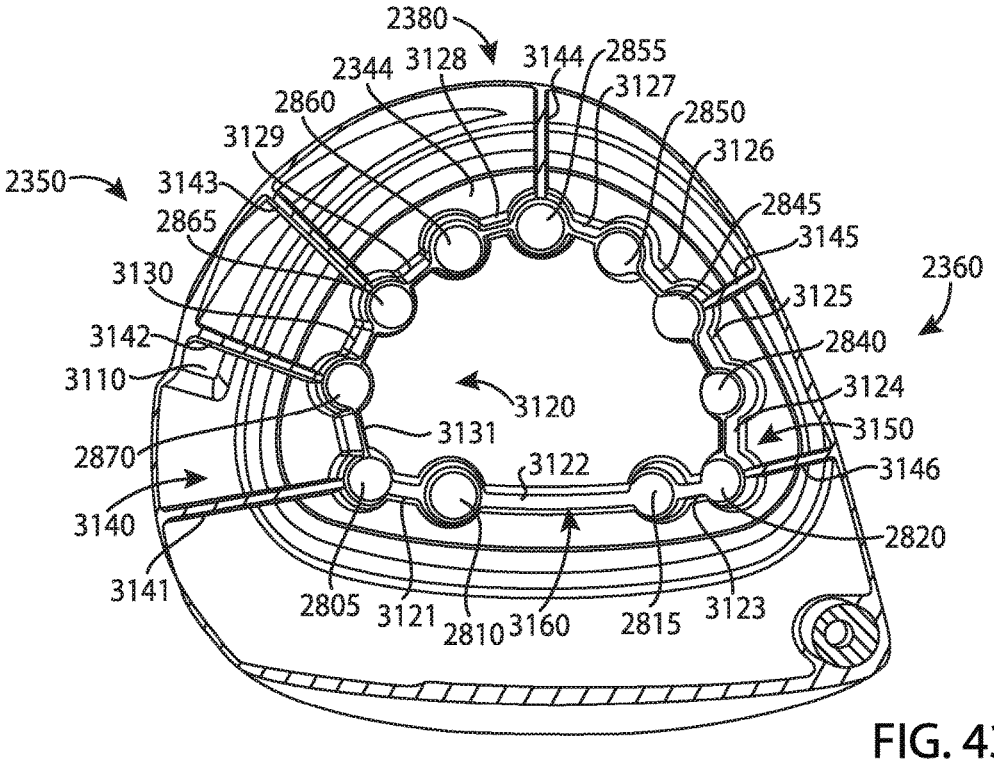
FIG. 43 depicts a cross-sectional view of another example of the golf club head of FIG. 23 taken at section line 31-31 of FIG. 29.

Any of the golf club heads described herein may have different configurations of outer support portions and/or inner support portions to provide structural support for the golf club head during impact with a golf ball depending on the size, thickness, materials of construction and/or other characteristics of any portions and/or parts of the golf club head. The different configurations of the outer support portions and/or inner support portions may affect vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein. For example, FIG. 43 shows another example of the golf club head 2300 with a different configuration of the first set of inner support portions 3120. In the example of FIG. 43, the inner surface 2344 may include a first set of inner support portions 3120 (generally shown as inner support portions 3121, 3122, 3123, 3124, 3125, 3126, 3127, 3128, 3129, 3130 and 3131), and a second set of inner support portions 3140 (generally shown as inner support portions 3141, 3142, 3143, 3144, 3145, and 3146). Accordingly, the golf club head 2300 of FIG. 43 may be similar to the golf club head 2300 of FIG. 31, except that the golf club head 2300 of FIG. 43 does not include the inner support portions 3132 and 3133. The apparatus, methods, and articles of manufacture described herein are not limited in this regard.

Figure 44:
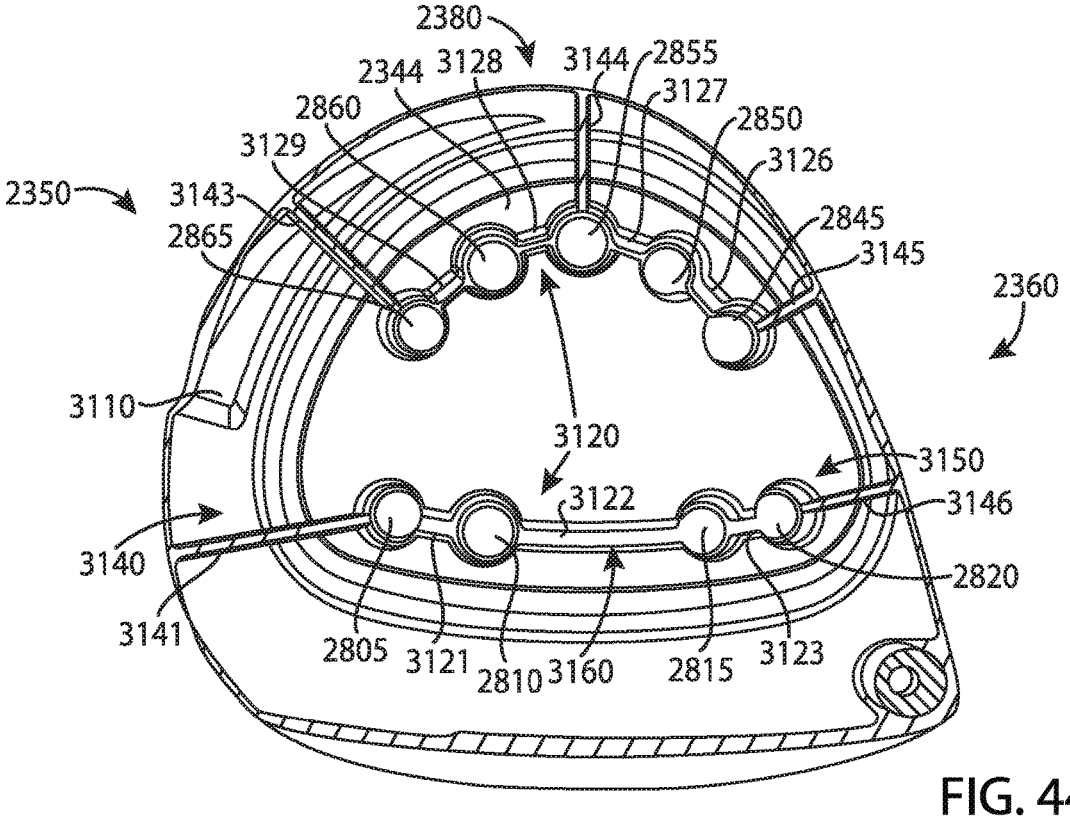
FIG. 44 depicts a cross-sectional view of another example of the golf club head of FIG. 23 taken at section line 31-31 of FIG. 29.

In addition to any of the golf club heads described herein having different configurations of outer support portions and/or inner support portions, any of the golf club heads described herein may have different configurations of weight ports in combination with different configurations of the outer support portions and/or the inner support portions. The different configurations of the weight ports may affect the weight distribution of the golf club head. The different configurations of the outer support portions and/or inner support portions may affect stiffness, vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more or less weight ports than some of the example golf club heads described herein. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein. FIG. 44 shows another example of the golf club head 2300 with a different configuration of the weight ports 2800, different configuration of the first set of inner support portions 3120, and different configuration of the second set of inner support portions 3140. In the example of FIG. 44, the bottom portion 2340 may include a plurality of weight ports 2800, which are generally shown as 2805, 2810, 2815, 2820, 2845, 2850, 2855, 2860, and 2865. Accordingly, the golf club head 2300 of FIG. 44 is similar to the golf club head 2300 of FIG. 31, except that the golf club head 2300 of FIG. 44 may not include weight ports 2840 and 2870. Also, in the example of FIG. 44, the inner surface 2344 of the bottom portion 2340 may include a first set of inner support portions 3120 (generally shown as inner support portions 3121, 3122, 3123, 3126, 3127, 3128, and 3129), and a second set of inner support portions 3140 (generally shown as inner support portions 3141, 3143, 3144, 3145, and 3146). Accordingly, the golf club head 2300 of FIG. 44 may be similar to the golf club head 2300 of FIG. 31, except that the golf club head 2300 of FIG. 44 does not include the inner support portions 3124, 3125, 3130, 3131, 3132, 3133 and 3142. The apparatus, methods, and articles of manufacture described herein are not limited in this regard.

Figure 45:
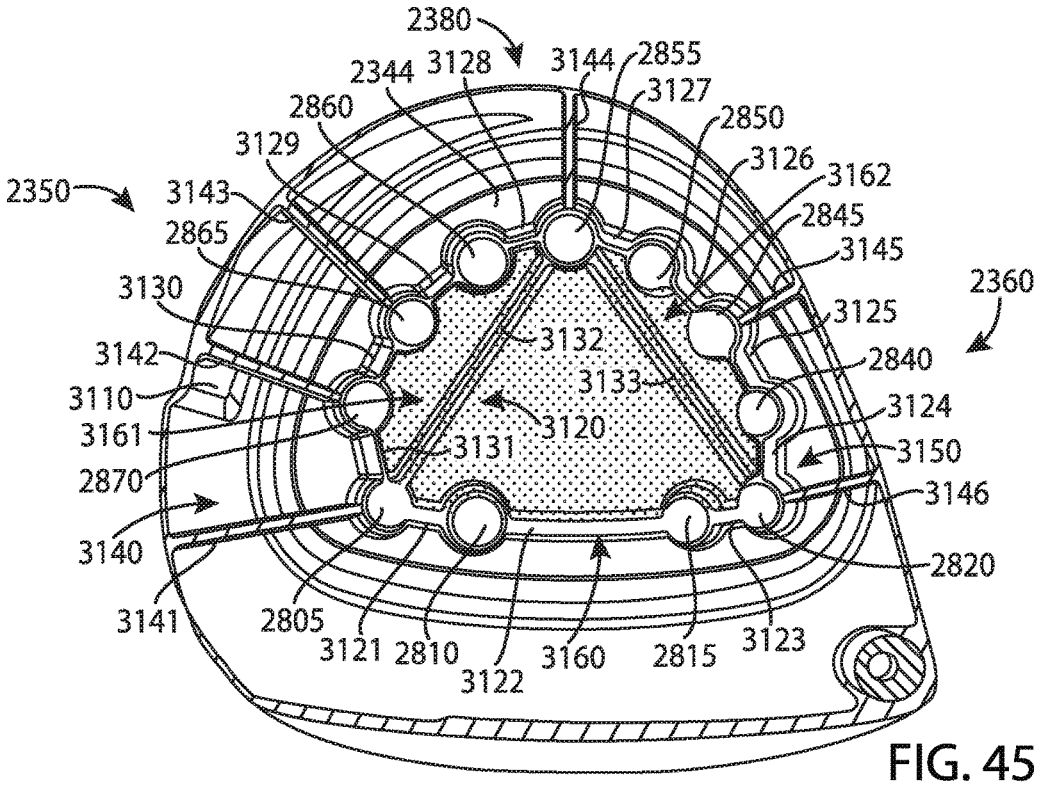
FIG. 45 depicts a cross-sectional view of another example golf club head of FIG. 23 taken at section line 31-31 of FIG. 29.

In one example shown in FIG. 45, certain regions of the interior of the body portion 2310 of the golf club head 2300 may include an elastic polymer material or an elastomer material, which may be referred to herein as the filler material. The filler material may dampen vibration, dampen noise, lower the center of gravity and/or provide a better feel and sound for the golf club head 2300 when striking a golf ball (not shown). According to one example, the triangular support region 3160 may be filled with the filler material. The filler material may extend from the inner surface 2344 of the bottom portion 2340 up to a height of any of the inner support portions 3122, 3132 and/or 3133. However, the filler material may extend below or above the height of any of the inner support portions 3122, 3132 and/or 3133. Further, the thickness of the filler material, which may be defined as the distance the filler material extends from the inner surface 2344 of the bottom portion 2340, may vary. In one example, the thickness of the filler material may be greater around a center portion of the triangular support region 3160 than the sides of the triangular support region 3160. In another example, the thickness of the filler material may be less around a center portion of the triangular support region 3160 than the sides of the triangular support region 3160. The apparatus, methods, and articles of manufacture described herein are not limited in this regard.

According to another example, a support region 3161 defined by the inner support portions 3128, 3129, 3130, 3131 and 3132 may be filled with the filler material. The filler material may extend from the inner surface 2344 of the bottom portion 2340 up to a height of any of the inner support portions 3128, 3129, 3130, 3131 and/or 3132. However, the filler material may extend below or above the height of any of the inner support portions 3128, 3129, 3130, 3131 and/or 3132. Further, the thickness of the filler material, which may be defined as the distance the filler material extends from the inner surface 2344 of the bottom portion 2340, may vary. In one example, the thickness of the filler material may be greater around a center portion of the support region 3161 than the sides of the support region 3161. In another example, the thickness of the filler material may be less around a center portion of the support region 3161 than the sides of the support region 3161. The apparatus, methods, and articles of manufacture described herein are not limited in this regard.

According to another example, a support region 3162 defined by the inner support portions 3124, 3125, 3136, 3127 and 3133 may be filled with the filler material. The filler material may extend from the inner surface 2344 of the bottom portion 2340 up to a height of any of the inner support portions 3124, 3125, 3136, 3127 and 3133. However, the filler material may extend below or above the height of any of the inner support portions 3128, 3129, 3130, 3131 and/or 3132. Further, the thickness of the filler material, which may be defined as the distance the filler material extends from the inner surface 2344 of the bottom portion 2340, may vary. In one example, the thickness of the filler material may be greater around a center portion of the support region 3162 than the sides of the support region 3162. In another example, the thickness of the filler material may be less around a center portion of the support region 3162 than the sides of the support region 3162. The apparatus, methods, and articles of manufacture described herein are not limited in this regard.

According to one example, any one or a combination of the support regions 3160, 3161 and/or 3162 may be filled with the filler material as described herein. In one example, only one support region (e.g., the support region 3160) may be filled with the filler material as described herein. Alternatively, two or more support regions may be filled with the filler material as described herein. For example, all of the support regions 3160, 3161 and 3162 may be filled with the filler material as shown in FIG. 45. In another example, only the support regions 3161 and 3162 may be filled with the filler material as described herein. In yet another example, only the support regions 3160 and 3161 may be filled with the filler material as described herein. In yet another example, only the support regions 3160 and 3162 may be filled with the filler material as described herein. Although the figures may depict a particular number of support regions, the apparatus, methods, and articles of manufacture described herein may include more or less support regions. The apparatus, methods, and articles of manufacture described herein are not limited in this regard.

Figure 46:
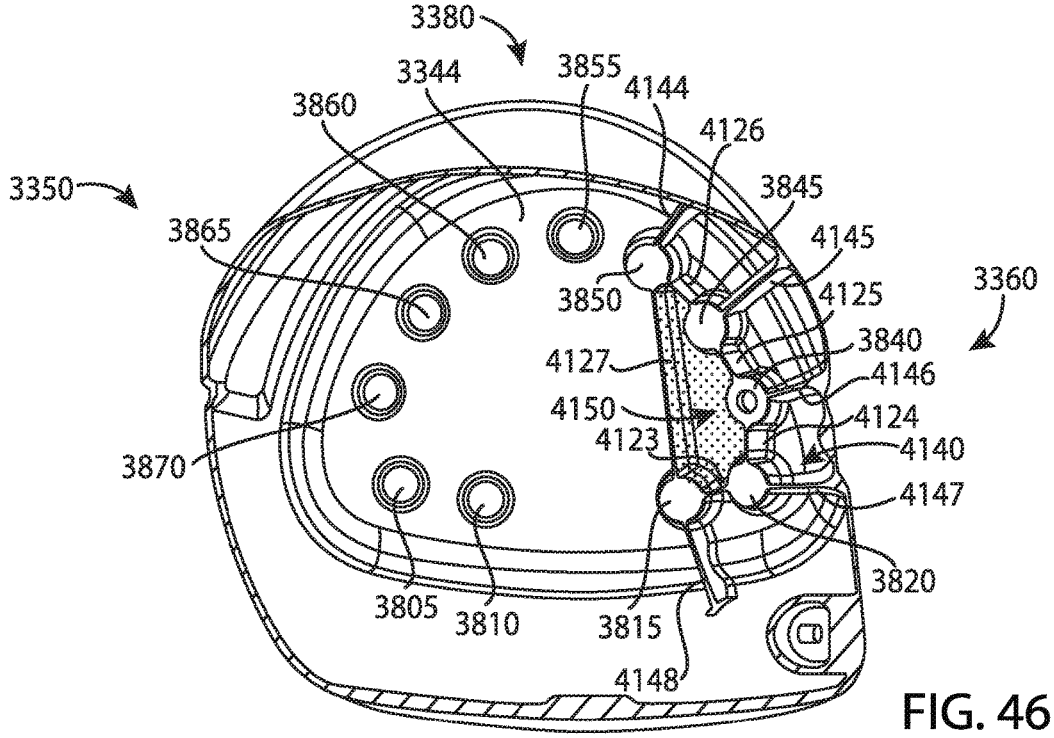
FIG. 46 depicts a cross-sectional view of another example golf club head of FIG. 33 taken at section line 41-41 of FIG. 39.

In one example shown in FIG. 46, certain regions of the interior of the body portion 3310 of the golf club head 3300 may include the filler material, which may be an elastic polymer material or an elastomer material as described. The filler material may dampen vibration, dampen noise, lower the center of gravity and/or provide a better feel and sound for the golf club head 3300 when striking a golf ball (not shown). According to one example, the support region 4150 may be filled with the filler material. The filler material may extend from the inner surface 3344 of the bottom portion 3340 up to a height of any of the inner support portions 4123, 4124, 4125, 4126 and/or 4127. However, the filler material may extend below or above the height of any of the inner support portions 4123, 4124, 4125, 4126 and/or 4127. Further, the thickness of the filler material, which may be defined as the distance the filler material extends from the inner surface 2344 of the bottom portion 2340, may vary. In one example, the thickness of the filler material may be greater around a center portion of the support region 4150 than the sides of the support region 4150. In another example, the thickness of the filler material may be less around a center portion of the support region 4150 than the sides of the support region 4150. The apparatus, methods, and articles of manufacture described herein are not limited in this regard.

Figure 47:
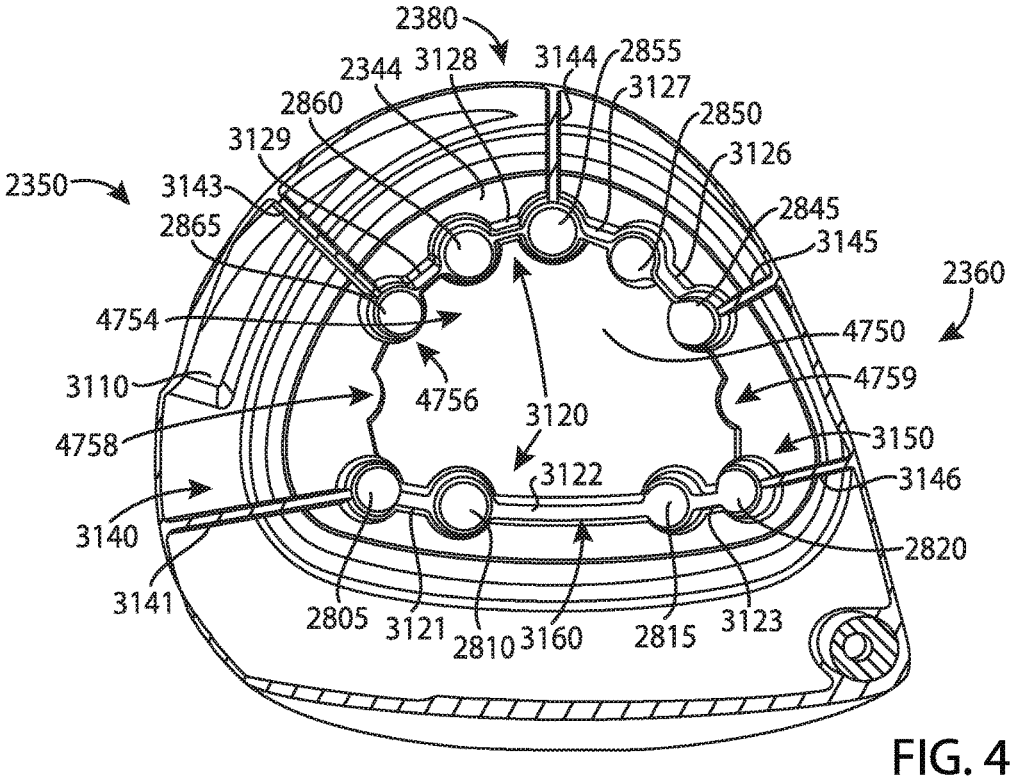
FIG. 47 depicts a cross-sectional view of another example of the golf club head of FIG. 23 taken at section line 31-31 of FIG. 29.

Any of the golf club heads described herein may have one or more interior regions that may include a filler material as described. In one example, the filler material be injected into a region of the golf club head from one or more ports on the golf club head to cover or fill the region. The one or more ports that may be used to inject the filler material may be one or more of the weight ports described herein. Accordingly, the filler material may be molded to the shape of the region in which the filler material is injected to cover or fill the region. Alternatively, one or more inserts may be formed from elastic polymer material or an elastomer material (i.e., filler material) and placed in one or more regions of the interior of golf club head. FIG. 47 shows an example of the golf club head 2300 of FIG. 44 with an insert 4750, which may be constructed from an elastic polymer material or an elastomer material. The insert 4750 may be manufactured to have a similar shape as the shape of a region 4754 on the inner surface 2344 of the bottom portion 2340. Accordingly, the insert 4750 may have a curvature similar to the curvature of the bottom portion 2340 at the region 4754 to lay generally flat and in contact with the inner surface 2344 of the bottom portion 2340, have a shape that may be similar to the shape of the region 4754 to be inserted in the region 4754 and generally fit within the region 4754, and/or have a plurality of cutout portions 4756 to generally match the shape and/or contour of sidewall portions of each of the weight ports 2800. The apparatus, methods, and articles of manufacture described herein are not limited in this regard.

The insert 4750 may have a thickness that may be similar to the height of any of the weight ports 2800. Accordingly, when the insert 4750 is in the region 4754, the top portion of the insert 4750 at or proximate to the weight ports 2800 may be at the same height as the weight ports 2800. However, the thickness of the insert 4750 may vary such that the thickness of the insert 4750 at any location of the insert 4750 may be more or less than the height of any of the weight ports 2800. The insert 4750 may dampen vibration, dampen noise, lower the center of gravity and/or provide a better feel and sound for the golf club head 2300 of FIG. 47 when striking a golf ball (not shown). The apparatus, methods, and articles of manufacture described herein are not limited in this regard.

The insert 4750 may be manufactured for use with any of the golf club heads described herein. As shown in FIG. 47, the insert 4750 may include a plurality of cutout portions 4756 that may generally match the shape of the outer wall portions of the weight ports 2800. The insert 4750 shown in FIG. 47 further includes cutout portions 4758 and 4759. Referring back to FIG. 43, when the insert 4750 is used with the golf club head 2300 of FIG. 43, the cut out portions 4758 and 4759 may generally match the shape of the outer wall portions of the weigh ports 2870 and 2840, respectively. Accordingly, the insert 4750 can be used in both the golf club head 2300 of FIG. 43 and the golf club head 2300 of FIG. 44.

Referring back to FIG. 31, the insert 4750 may include channels, grooves or slots (not shown) that may be sized and shaped to receive the inner support portions 3132 and 3133 therein. Accordingly, an insert 4750 may be manufactured with the described channels, grooves or slot for use with the golf club heads 2300 of FIG. 31, FIG. 43 and FIG. 44. Alternatively, one or more inserts may be manufactured that may only fit one of the golf club heads described herein. For example, each of the golf club heads described herein may include one or more inserts that may have a certain shape for fitting only within one or more regions in the golf club head. Referring back to FIG. 31, for example, the golf club head 2300 may include a first insert (not shown) for fitting in the support region 3161, a second insert (not shown) for fitting in the triangular support region 3160, and a third insert (not shown) for fitting in the support region 3162. Referring back to FIG. 41, for example, the golf club head 3300 may include an insert (not shown) for fitting in the support region 4150. The apparatus, methods, and articles of manufacture described herein are not limited in this regard.

Figure 48:
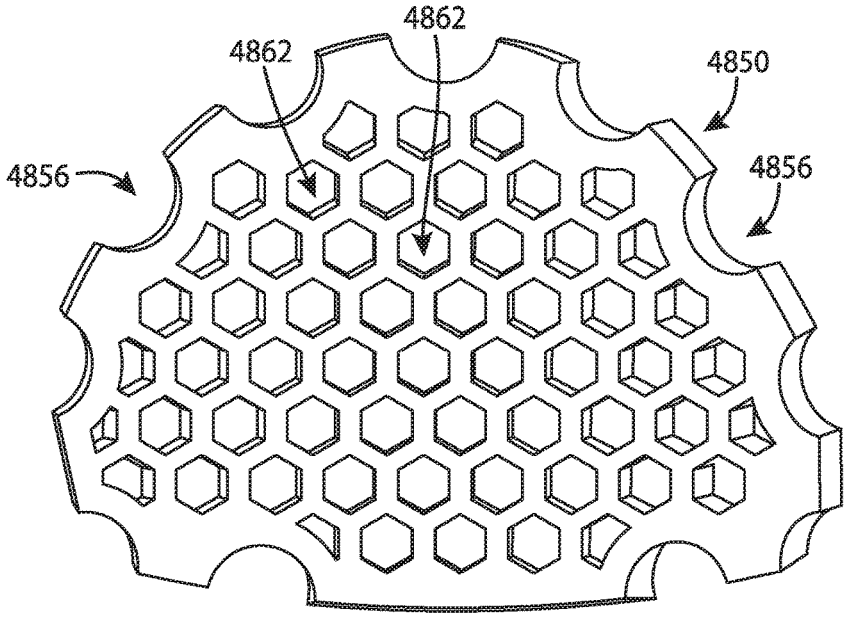
FIG. 48 depicts a perspective view of an elastic polymer insert according to an embodiment of the apparatus, methods, and articles of manufacture described herein.

Any of the inserts described herein may be manufactured from an elastic polymer material as a one-piece continuous part. In the example of FIG. 47, the insert 4750 may be a one-piece continuous part without any recesses and/or holes. Referring to FIG. 48 illustrates an insert 4850 that is similar in many respects to the insert 4750. Accordingly, in one example, the insert 4850 may be manufactured to have a similar shape as the shape of the region 4754 on the inner surface 2344 of the bottom portion 2340 of the golf club head 23 of FIG. 47 and further include a plurality of cutout portions 4856 as described herein. The insert 4850 further includes a plurality of holes 4862 that may reduce the weight of the insert 4850. The insert 4850 may include any number of holes 4862 arranged in any configuration on the insert 4850. In the example of FIG. 48, the insert 4850 includes a plurality of hexagonal holes 4862 that extend through the thickness of the insert 4850 and are arranged on the insert 4850 similar to a honeycomb pattern. The holes 4862 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 4850. In one example, the insert 4850 may include a plurality of round holes (not shown). In another example, the insert 4850 may include a plurality of slots, grooves and/or slits (not shown). In yet another example, the insert 4850 may include recesses (not shown) instead of holes that do not extend through the insert 4850. The apparatus, methods, and articles of manufacture described herein are not limited in this regard.

The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material including any of the inserts that may be manufactured from the filler material as described herein may be bonded, attached and/or connected to any of the golf club heads described herein by a bonding portion (not shown) to improve adhesion and/or mitigate delamination between the body portion of any of the golf club heads described herein and the filler material. The bonding portion may be a bonding agent, an epoxy, a combination of bonding agents, a bonding structure or attachment device, a combination of bonding structures and/or attachment devices, and/or a combination of one or more bonding agents, one or more bonding structures and/or one or more attachment devices. In one example, the bonding portion may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion may be LOCTITE® materials manufactured by Henkel Corporation, Rocky Hill, Conn. The apparatus, methods, and articles of manufacture are not limited in this regard.

Figure 49:
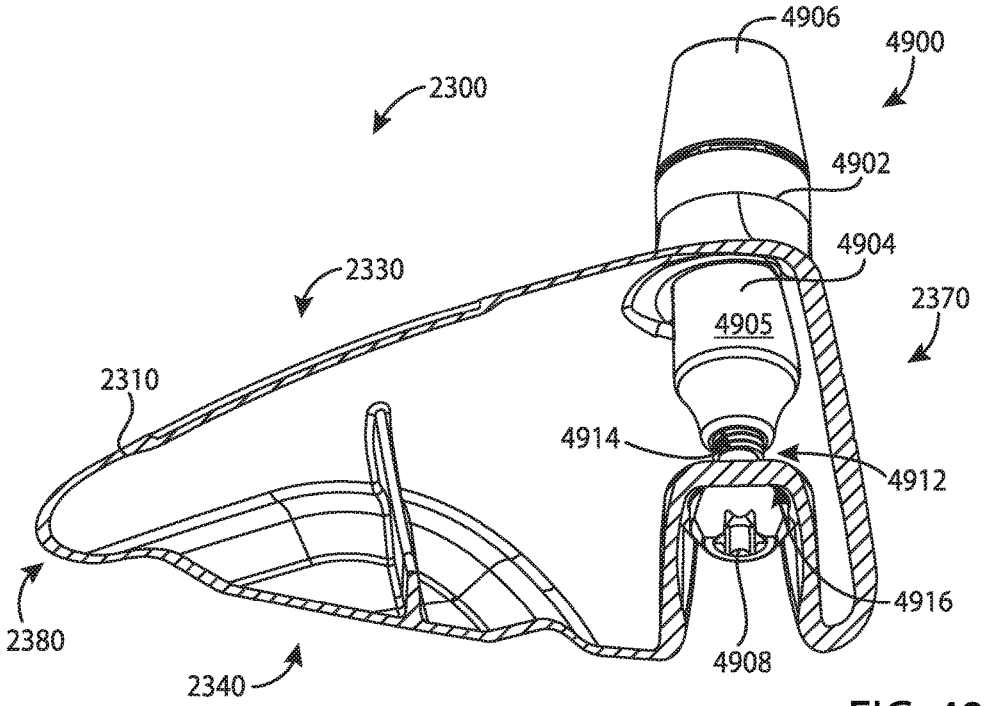
FIG. 49 depicts a side perspective cross-sectional view of another example of the golf club head of FIG. 23 taken at section line 49-49 of FIG. 27 according to an embodiment of the apparatus, methods, and articles of manufacture described herein.
Figure 50:
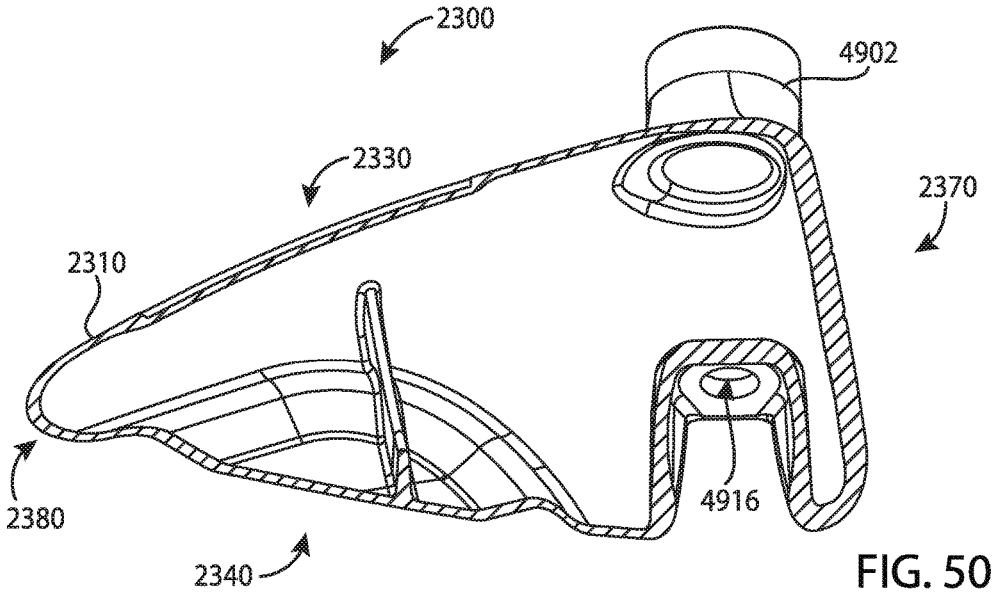
FIG. 50 depicts a side perspective cross-sectional view of another example of the golf club head of FIG. 45 taken at section line 49-49 of FIG. 27.

Turning to FIGS. 49 and 50, for example, the golf club head 2300 may include a hosel assembly 4900 with a hosel 4902, a hosel sleeve 4904, and a fastener 4908. In one example, the hosel 4902 may extend outward from the top portion 2330 and does not extend into the body portion 2310. The hosel 4902 may be configured to receive the hosel sleeve 4904 such that a portion of the hosel sleeve 4904 may located inside the body portion 2310 as shown in FIG. 49. The hosel sleeve 4904 may include an outer wall 4905 and a ferrule portion 4906. The outer wall 4905 of the portion of the hosel sleeve 4904 inside the body portion 2310 may be exposed to the interior space or the hollow space of the body portion 2310. In other words, as shown in FIG. 50, the hosel 4902 does not extend into the body portion 2310 and the body portion 2310 does not include any structure to surround or cover the hosel sleeve 4904. The apparatus, methods, and articles of manufacture described herein are not limited in this regard.

The hosel sleeve 4904 may be attached to the hosel 4902 and/or the body portion 2310 by one or more fasteners, one or more adhesives, welding, one or more mechanical locking mechanisms, and/or a combination thereof. In one example shown in FIG. 49, the hosel sleeve 4904 may be fixed to the body portion by the fastener 4908, which may be a threaded fastener such as a bolt. The hosel sleeve 4904 may include a first end configured to receive a shaft (not shown) and a second end 4912 having a threaded bore 4914. The bottom portion 2340 may include an opening 4916 configured to receive the fastener 4908. The opening 4916 may be generally axially aligned with the threaded bore 4914 at the second end 4912 of the hosel sleeve 4904 when the hosel sleeve 4904 is inserted into the hollow body portion 2310 through the hosel 4902 as shown in FIG. 49. The fastener 4908 may be inserted into the opening 4916 and threaded into the threaded bore 4914 of the hosel sleeve 4904 to fasten the hosel sleeve 4904 to the hosel 4902 and/or to the body portion 2310. A shaft (not shown) may then be inserted and affixed in the hosel sleeve 4904. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion having a front portion, a rear portion, a toe portion, a heel portion, a top portion, and a bottom portion having an inner surface and an outer surface;

a plurality of ports extending from the outer surface of the bottom portion into the hollow body portion, the plurality of ports defining a port region at or near the inner surface of the bottom portion, and a polymer insert located in the port region and at least partially surrounded by the plurality of ports, the polymer insert being in contact with the inner surface of the bottom portion and extending from the inner surface of the bottom portion into the hollow body portion, wherein the polymer insert comprises a plurality of recesses.

2. A golf club head as defined in claim 1, wherein the plurality of recesses include a plurality of hexagonal recesses in a honeycomb configuration.

3. A golf club head as defined in claim 1, wherein the polymer insert is attached to the inner surface of the bottom portion with a bonding agent.

4. A golf club head as defined in claim 1 wherein the polymer insert is configured to fill the port region.

5. A golf club head as defined in claim 1, wherein each port of the plurality of ports contacts a perimeter portion of the polymer insert.

6. A golf club head as defined in claim 1, wherein a perimeter of the polymer insert includes a plurality of indented portions, and wherein each indented portion of the plurality of indented portions is configured to receive at least a portion of a port of the plurality of ports.

7. A golf club head comprising:

a hollow body portion having a front portion, a rear portion, a toe portion, a heel portion, a top portion, and a bottom portion having an inner surface and an outer surface;

a plurality of ports extending from the outer surface of the bottom portion into the hollow body portion, the plurality of ports including a first set of ports having at least three ports being closer to the front portion than the rear portion, and a second set of ports having at least three ports being closer to the rear portion than the front portion, and a polymer material located between the first set of ports and the second set of ports, the polymer material being in contact with the inner surface of the bottom portion and extending from the inner surface of the bottom portion into the hollow body portion, wherein the polymer material is an elastic polymer insert comprising a plurality of recesses.

8. A golf club head as defined in claim 7, wherein the a plurality of recesses include a plurality of hexagonal recesses in a honeycomb configuration.

9. A golf club head as defined in claim 7, wherein the polymer material is attached to the inner surface of the bottom portion with a bonding agent.

10. A golf club head as defined in claim 7, wherein the polymer material is configured to fill a region at or near the inner surface of the bottom portion between the first set of ports and the second set of ports.

11. A golf club head as defined in claim 7, wherein the polymer material is an elastic polymer insert, wherein a perimeter of the elastic polymer insert includes a plurality of indented portions, and wherein each indented portion of the plurality of indented portions is configured to receive at least a portion of a port of the plurality of ports.

12. A golf club head comprising:

a hollow body portion having a front portion, a rear portion, a toe portion, a heel portion, a top portion, and a bottom portion having an inner surface and an outer surface;

a first inner support portion defining a wall extending from the inner surface of the bottom portion into the hollow body portion, the first inner support portion being closer to the front portion than the rear portion;

a second inner support portion defining a wall extending from the inner surface of the bottom portion into the hollow body portion, the second inner support portion being closer to the rear portion than the front portion;

an elastic polymer insert attached to the inner surface of the bottom portion between the first inner support portion and the second inner support portion, the elastic polymer insert extending from the inner surface of the bottom portion into the hollow body portion, and a plurality of ports extending from the outer surface of the bottom portion into the hollow body portion, wherein a perimeter of the elastic polymer insert includes a plurality of indented portions, and wherein each indented portion of the plurality of indented portions is configured to receive at least a portion of a port of the plurality of ports.

13. A golf club head as defined in claim 12, wherein the elastic polymer insert comprises a plurality of recesses.

14. A golf club head as defined in claim 12, wherein the elastic polymer insert comprises a plurality of hexagonal recesses in a honeycomb configuration.

15. A golf club head as defined in claim 12, wherein the elastic polymer insert is attached to the inner surface of the bottom portion with a bonding agent.

16. A golf club head as defined in claim 12, wherein the elastic polymer insert is configured to fill a region at or near the inner surface of the bottom portion between the first inner support portion and the second inner support portion.

17. A golf club head as defined in claim 12, wherein the first inner support portion and the second inner support portion extend in the same direction as a portion of a perimeter of the elastic polymer insert.

* * * * *